US007643783B2

(12) United States Patent
Nakagawa et al.

(10) Patent No.: US 7,643,783 B2
(45) Date of Patent: Jan. 5, 2010

(54) IMAGE FORMING APPARATUS EMPLOYING AN ELECTROPHOTOGRAPHIC METHOD

(75) Inventors: Atsushi Nakagawa, Toride (JP); Hidehiko Kinoshita, Kashiwa (JP); Jun Yamaguchi, Fujisawa (JP); Masaaki Moriya, Moriya (JP); Manabu Mizuno, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/850,358

(22) Filed: Sep. 5, 2007

(65) Prior Publication Data

US 2008/0069578 A1 Mar. 20, 2008

(30) Foreign Application Priority Data

Sep. 14, 2006 (JP) ..... 2006-249954

(51) Int. Cl.
*G03G 15/00* (2006.01)

(52) U.S. Cl. ..... 399/302; 399/45; 399/49; 399/301

(58) Field of Classification Search ..... 399/301, 399/302, 394, 159, 160, 162, 167, 49, 45; 347/116

See application file for complete search history.

(56) References Cited

U.S. PATENT DOCUMENTS 6,655,774 B2 * 12/2003 Maruyama
6,801,727 B2 * 10/2004 Maruyama et al. ..... 399/45
2007/0231021 A1 * 10/2007 Kinoshita et al. ..... 399/301

* cited by examiner

*Primary Examiner*—David M Gray
*Assistant Examiner*—G. M. Hyder
(74) *Attorney, Agent, or Firm*—Fitzpatrick, Cella, Harper & Scinto

(57) ABSTRACT

A CMOS sensor scans an image that is either on a transfer material carrier or on a transfer material that is placed on the transfer material carrier. A sampling timing controller samples an image signal at a predetermined sampling rate and computes a position of a predetermined pattern contained within the sampled image signal. A speed computation processor computes a moving speed of either the transfer material carrier or the transfer material, based on the position of the predetermined pattern thus sampled at the predetermined sampling rate and computed, as well as the predetermined sampling rate. The image region that the CMOS sensor scans is determined in accordance with the rotational speed of the drive motor and the sampling rate.

9 Claims, 25 Drawing Sheets

IMAGE FORMING APPARATUS EMPLOYING AN ELECTROPHOTOGRAPHIC METHOD

This application claims the benefit of Japanese Patent Application No. 2006-249954, filed Sep. 14, 2006, which is hereby incorporated by reference herein in its entirety.

BACKGROUND OF THE INVENTION

1. Field of the Invention

The present invention relates to an image forming apparatus that employs an electrophotographic method to form an image.

2. Description of the Related Art

The primary modes of a transfer system pertaining to a conventional image forming apparatus of a tandem system are a direct transfer system and an intermediate transfer system, the latter of which employs an intermediate transfer member to perform a secondary transfer. The direct transfer system comprises a feeding belt, which carries and conveys a sheet of printing paper. Yellow (Y), magenta (M), cyan (C), and black (Bk) process cartridges ("cartridges"), are placed in tandem, aligned along a feeding direction of the feeding belt. An optical unit is installed thereupon, corresponding to each cartridge. A transfer roller is also positioned that sandwiches the feeding belt, corresponding to a photosensitive drum, i.e., an image carrier, of each respective cartridge. Given such a configuration, yellow, magenta, cyan, and black toner images, which are obtained via an established electrophotographic method are overlaid upon, and transferred to, the sheet of printing paper that is supplied from a printing paper cartridge to the feeding belt. The toner image that is transferred to the sheet of printing paper is fixed by a fixing unit, and discharged from the apparatus via an output sensor and a conveyor path.

When forming a toner image on the reverse side of the sheet of printing paper as well as the obverse, the sheet of printing paper that is discharged from the fixing unit is conveyed once more to the feeding belt via another path, and the image is formed on the reverse of the sheet of printing paper via a sequence of steps similar to the foregoing. The feeding belt is driven by a conveyor drive roller thereof. The drive motor of the feeding belt is driven to rotate in a set speed of rotations in order to obtain a high quality image.

The intermediate transfer system, on the other hand, possesses an intermediate transfer belt, whereupon a primary transfer of images that are formed in the photosensitive drums is performed, and the image that has been primarily transferred on the intermediate transfer belt is further transferred to form on the sheet of printing paper via a secondary transfer. The drive motor of the intermediate transfer belt is driven to rotate in a set speed of rotations in order to obtain a high quality image.

When both of the transfer systems are concerned, such factors as control of the temperature of a heater within the fixing unit, or heat emitted by the various drive motors, causes the temperature to rise within the image forming apparatus, with the feeding belt or the intermediate transfer belt experiencing either thermal expansion or contraction, and the speed of conveyance speeding up and slowing down, resulting in a lack of uniformity thereof. Consequently, a misalignment in color from a specific position of the sheet of printing paper may occur when each respective color toner image is transferred, resulting in significant degradation in quality of the image thus formed. Control of the conveyance of the feeding belt or the intermediate transfer belt involves controlling the rotation of the drive motor so as to maintain a constant fixed speed, and thus, a virtual radius of the feeding belt or the intermediate transfer belt being altered by thermal expansion may lead to a lack of uniformity in surface speed thereof, and a resulting misalignment in color.

U.S. Pat. No. 6,655,774 recites a method of solving such a problem by scanning an image on the sheet of printing paper, the feeding belt, or the intermediate transfer belt, deriving the speed in motion thereof, and flexibly controlling the rotational speed of each respective drive motor.

The configuration of U.S. Pat. No. 6,655,774 is limited, however, to a belt surface region, i.e., a number of pixels in a detected image, which can be detected in a single sample. The following is a description thereof.

FIG. 1 describes the related art.

FIG. 1 depicts an area sensor 100, which possesses a sensor element with dimensions of m pixels in the moving direction of the intermediate transfer belt (or feeding belt or sheet of printing paper, hereinafter collectively "belt") 101, and n pixels in the perpendicular orientation thereto. In the present circumstance, the belt 101 moves in the direction denoted by reference numeral 102. A of FIG. 1 depicts a top view, and B of FIG. 1 depicts a side elevation view.

A target pattern is determined from an image 103 that is sampled at a time t, with a barycenter of the pattern treated as a target 104. The trajectory of the target 104 is sampled at a predetermined sampling rate, and the speed at the surface of the belt 101 calculated from the distance thus sampled. The moving speed at which the belt 101 moves is subject to fluctuation depending on the type of sheet of printing paper. Using a thick sheet of printing paper or cardboard, for example, reduces the process speed, i.e., the speed of image forming, compared with a sheet of plain printing paper, in order to increase the fixing characteristic thereof. A problem that arises as a result is the relation between an area of detection and the processing time. The following is a description of what happens with (a) a slow moving speed, i.e., thick paper/cardboard mode; (b) a fast moving speed, i.e., plain printing paper mode; and (c) when the area of detection is expanded due to the fast moving speed.

FIGS. 2 through 4 describe detecting a moving speed of a belt in a conventional manner.

Reference numeral 111 in FIG. 2, i.e., slow moving speed, denotes an image that is detected by the sensor 100 at a time t1. Reference numeral 112 denotes an image that is detected by the sensor 100 at a time t2, where $t1<t2$. The overall detection area of the sensor 100 detects the images 111 and 112 at different timings. Reference numeral 113 denotes a target. Va denotes the moving speed of the belt 101 at the time depicted. The relation "e2−e1" is the processing time period for the image 111 that is scanned by the sensor 100 ("e1 indicated a start timing of the processing and "e2" indicates an end timing of the processing). The time period is shorter than the interval for sampling from the time t1 to the time t2, "t2−t1". The example depicted in FIG. 2 contains the distance within the sampling interval, i.e., 4=6−2, within the area of the sensor 100. The image 111 is detected at the time t1, and the coordinates Y1=2 of the target 113 of the image 111 thus detected are processed at the time e1, after which the image 112 is detected at the time t2. A target 113' may be identified within the image 112, and the coordinates Y2=6 thereof detected. It is thus possible to derive the distance of the belt (Y2−Y1=4) between the time t1 and the time t2.

FIG. 3 represents an example of detection when the moving speed Vb of the belt 101 is rapid, and $Va<Vb$. Reference numerals 121 and 122 denote images that the overall detection area of the sensor 100 detects at different timings. The image 121 is detected at the time t1, and the coordinates Y1=2 of the target 113 of the image 121 thus detected are processed at the time e1, after which the image 122 is detected at the time t2. In such a circumstance, however, the fast speed of the belt 101 means that the target 113 protrudes into reference code U, which is outside the sensor area 100, and thus, the target 113 cannot be identified within the image 122. Consequently, the distance of the belt between the time t1 and the time t2, i.e., Y2=m+4, cannot be detected and thus, the distance (Y2−Y1) cannot be derived. If the moving speed of the belt is too fast, the target 113 will have already passed the sensor area by the time the next sampling timing arises, precluding detection of the speed of the belt 101.

FIG. 4 depicts an example of expanding an area 114 that is detected by the sensor 100 at the speed Vb that is depicted in FIG. 3. Reference numerals 131, 132, and 133 denote images that the overall detection area of the sensor 100 detects at different timings.

FIG. 3 depicts the detection of the image 121 at the time t1, and processing the coordinates Y1=2 of the target 113 in the image 121 thus detected at the time e2. In FIG. 4, the sensor area wherein an image 131 is detected at the time t1 is expanded, thus increasing the number of pixels handled thereby, and reducing the processing speed below the processing speed depicted in FIG. 3. Consequently, the processing up to the identification of the target 113 in the image 131 would not finished at the time t2 for the next sample, i.e., e2>t2. Hence, a target 113' will be within the sensor area 114 at the time t2, image processing will not be finished in time, owing to the increased number of pixels, and thus, the target 113' cannot be detected in the image 132. The sampling interval is thus presumed to be extended to a time t3 in order to allow for a sufficient time for processing of the image 131, where e2<t3. In such a circumstance, accuracy of detection of speed declines, and a target 113" falls into U, the region outside the sensor area 114, at the time t3, preventing identification of the target 113" within the image 133. As a result, the coordinates Y2=m+10 cannot be detected, and thus, the distance (Y2=Y1) of the belt between the time t1 and the time t3 cannot be derived. Raising the speed of the belt in such a manner thus prevents detecting the distance of the belt, even if the sensor area is expanded.

SUMMARY OF THE INVENTION

An aspect of the present invention is to eliminate the above-mentioned problems.

Moreover, another aspect of the present invention is to provide an image forming apparatus capable of detecting conveyance speed, and even fluctuations therewith, of a transfer material or an intermediate transfer member with high accuracy.

According to another aspect of the present invention, the conveyance speed of the transfer material or the intermediate transfer member is controlled, in response to fluctuations detected with the conveyance speed thereof.

According to an aspect of the present invention, there is provided an image forming apparatus comprising:

an image carrier configured to carry an image being driven by a driving source;

an image reading unit configured to read the image upon the image carrier, wherein a reading area of the image reading unit is segmented into a plurality of regions, and capable of reading a segmented image on each of the plurality of regions;

a sampling unit configured to sample an output of the image reading unit at a predetermined sampling unit;

a decision unit configured to decide first and second regions of the plurality of regions for respectively using in first and second samplings;

a position detection unit configured to detect positions of a predetermined pattern in the first region at the first sampling and the predetermined pattern in the second region at the second sampling; and a computation unit configured to compute a moving speed of the image carrier based on the predetermined sampling rate and the positions detected by the position detection unit, wherein the decision unit decides the second region on an assumption speed of the image carrier and the predetermined sampling rate.

The means to solve the problems have not all been enumerated within the scope of the present application, and other combinations of the recited claims and the characteristics thereof may also constitute the present invention.

Further features and aspects of the present invention will become apparent from the following description of exemplary embodiments, with reference to the attached drawings.

BRIEF DESCRIPTION OF THE DRAWINGS

The accompanying drawings, which are incorporated in, and constitute a part of the specification, illustrate embodiments of the invention and, together with the description, serve to explain the principles of the invention.

DESCRIPTION OF THE EMBODIMENTS

Numerous embodiments of the present invention will now be described below in detail with reference to the accompanying drawings. The following embodiments are not intended to limit the claims of the present invention and not all combination of the features described in the embodiments are necessarily essential as means for attaining the objects of the present invention.

Figure 1:
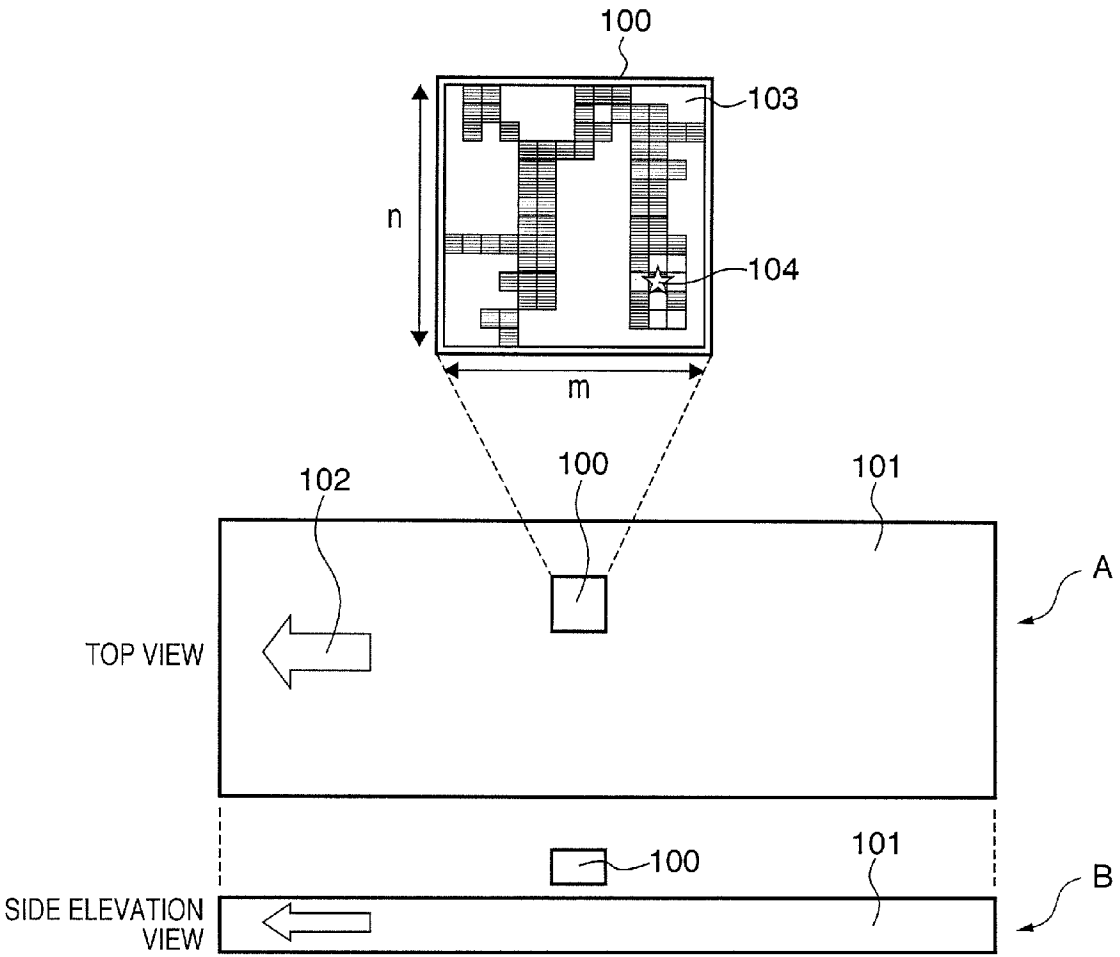
FIG. 1 depicts a diagram explaining the related art.
Figure 2:
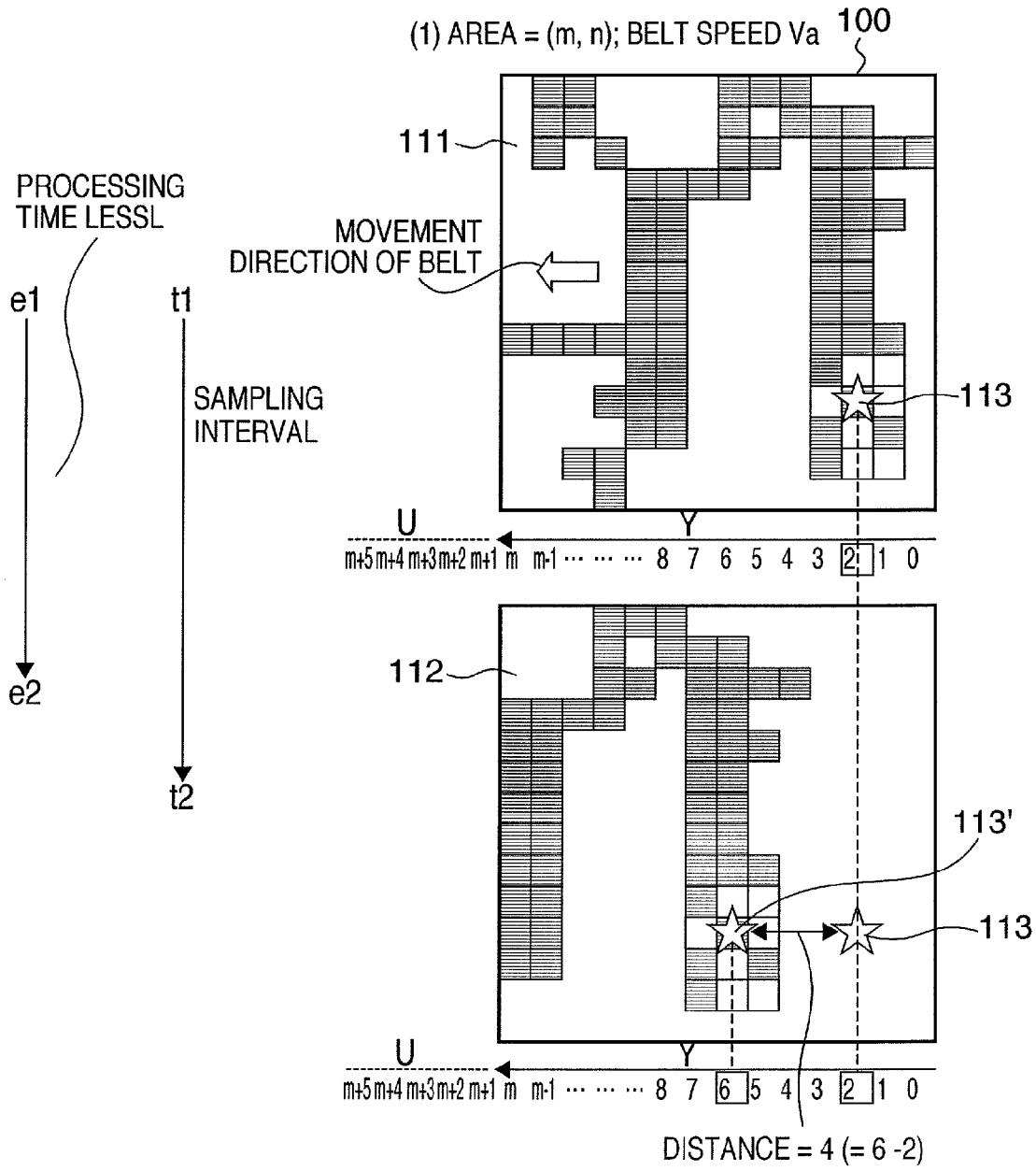
FIGS. 2 through 4 depict views explaining conventional detection of conveyance speed.
Figure 3:
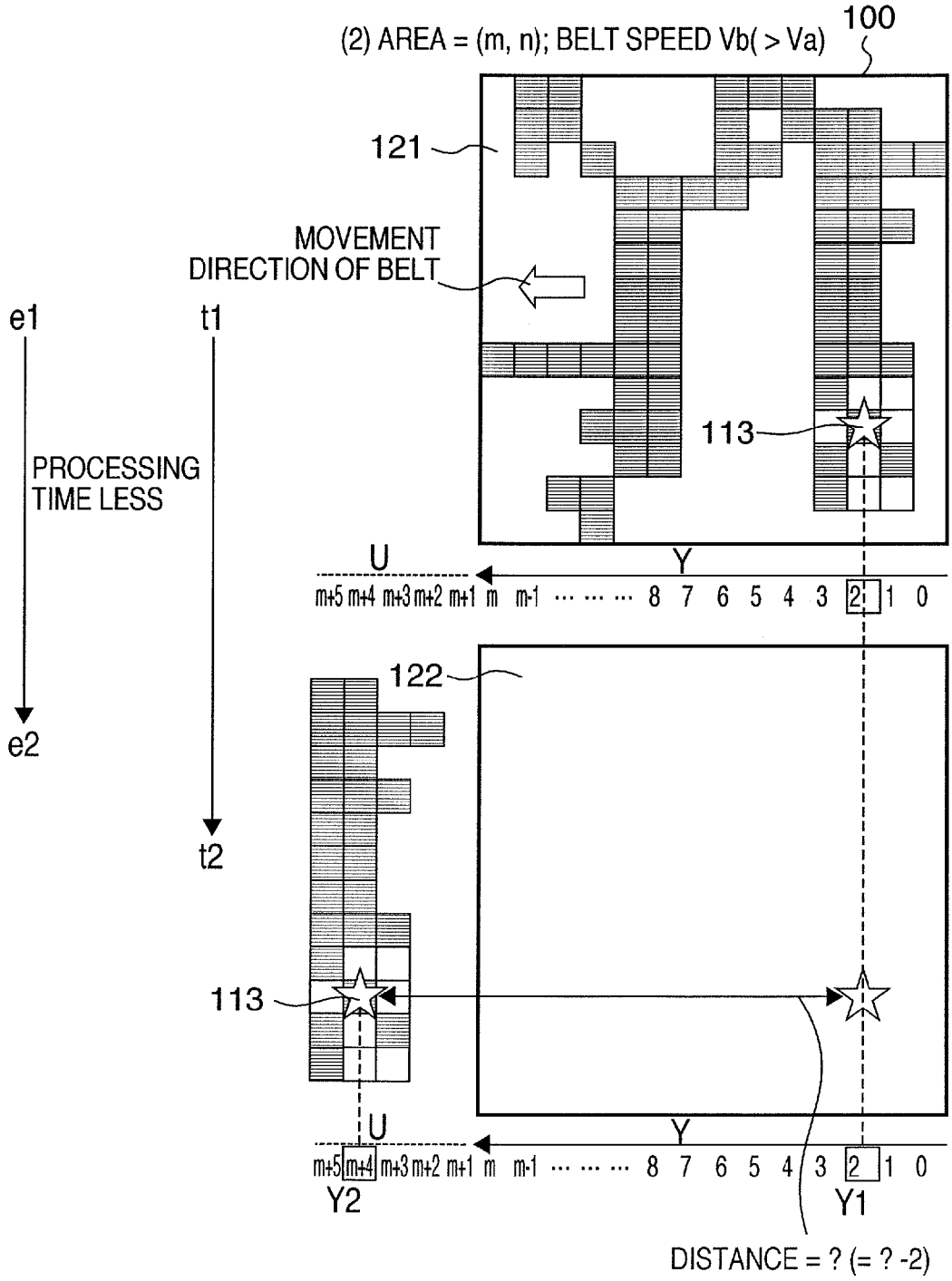
Figure 4:
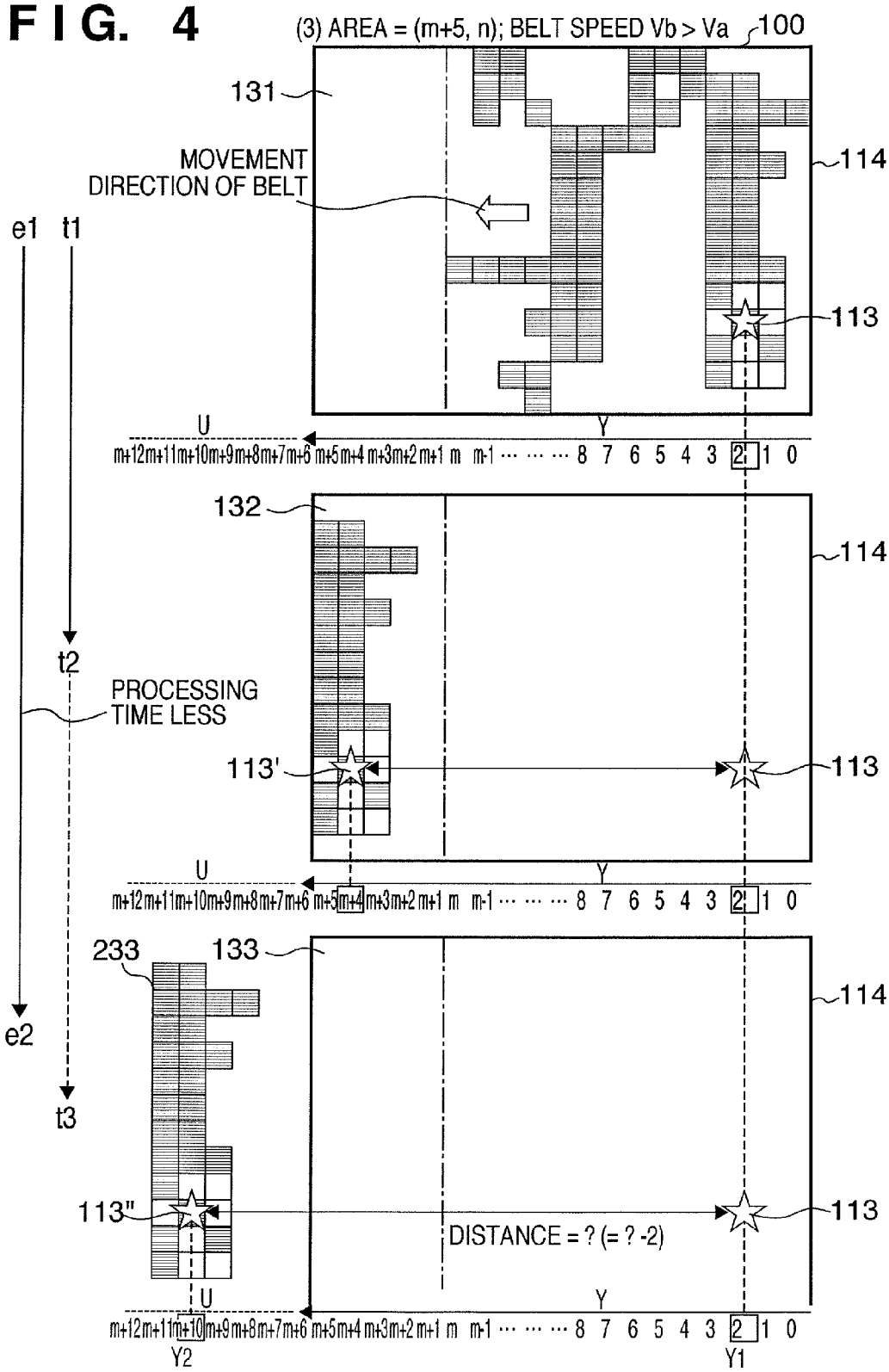
Figure 5:
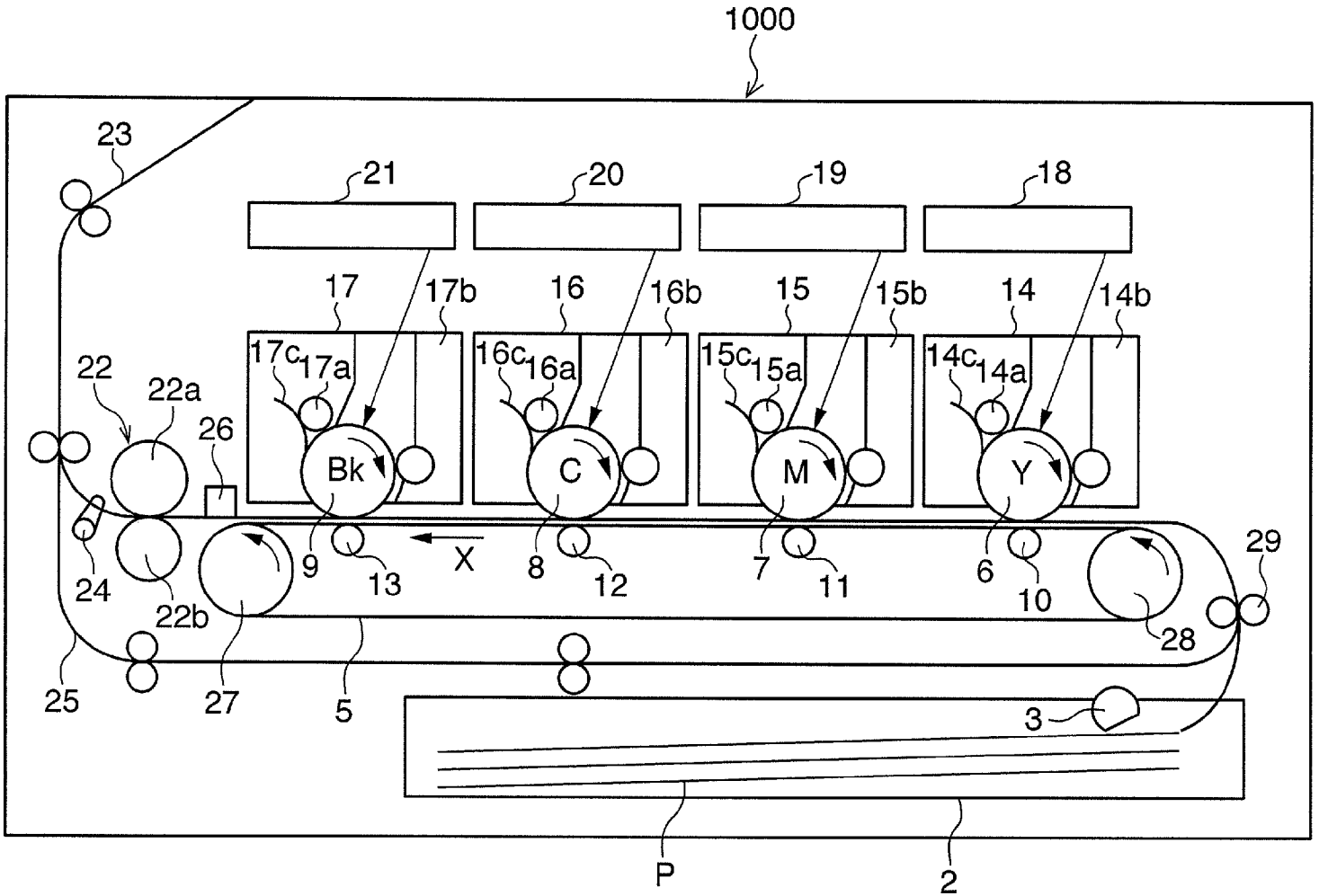
FIG. 5 depicts a cutaway conceptual view illustrating a configuration of an image forming apparatus, i.e., a laser printer, according to an exemplary embodiment of the present invention.

FIG. 5 depicts a cutaway conceptual view illustrating a configuration of an image forming apparatus, i.e., a laser printer, according to an exemplary embodiment of the present invention.

An image forming apparatus (printer) 1000 comprises a feeding belt 5, i.e., a transfer member, which conveys a transfer material P, i.e., a sheet of printing paper. Yellow, magenta, cyan, and black processes cartridges 14 through 17 ("cartridges") are placed in tandem as an image formation unit, aligned along the carrying surface of the feeding belt 5, in order from the upper end of the sheet of printing paper P, in the direction of the conveyance thereof. Scanner units 18, 19, 20, and 21 are respectively installed above the cartridges, corresponding to each of the cartridges 14 through 17. Transfer rollers 10, 11, 12, and 13 are each positioned, sandwiching the feeding belt 5, corresponding to each of the photosensitive drums 6, 7, 8, and 9 of each of the cartridges 14 through 17. The cartridges 14 through 17 respectively comprise charge rollers 14*a*, 15*a*, 16*a* and 17*a*, developers 14*b*, 15*b*, 16*b* and 17*b*, and cleaners 14*c*, 15*c*, 16*c* and 17*c*, which are placed around the periphery of each of the photosensitive drums 6 through 9. The feeding belt 5 is wound around a drive roller 27 and an idler roller 28, and moves in the direction signified by an arrow X in the diagram, in accordance with the rotation of the drive roller 27.

With regard to the preceding configuration, the sheet of printing paper P is supplied from a printing paper cartridge 2 to the feeding belt 5, by way of a pickup roller 3 and a printing paper feed conveyor roller 29. Toner images of yellow, magenta, cyan, and black are obtained via an established electrophotographic method, and are overlaid and transferred to the sheet of printing paper P. The toner image of the sheet of printing paper P is fixed to the sheet by a fixing unit 22 (22*a*, 22*b*), and the sheet is discharged from the apparatus via a discharge sensor 24 and a paper path 23. The fixing unit 22 is conceptually configured of a fixing roller 22*a*, which contains a heater, and a pressurizing roller 22*b*.

When forming a toner image on the reverse side of the sheet of printing paper P as well as the obverse, the sheet of printing paper P that is outputted from the fixing unit 22 is conveyed once more to the feeding belt 5 via another printing paper path 25, and the toner image is formed on the reverse of the sheet of printing paper P, via a sequence of steps similar to the foregoing.

The image forming apparatus 1000 provides an image sensor unit 26, which provides image scanning means, near to the black cartridge 17 and the feeder belt 5. The image sensor unit 26 detects an image in a particular area of either the feeding belt 5 or the sheet of printing paper P by shining light on the surface thereof, and collecting and focusing the light reflected therefrom.

The image sensor unit 26 is positioned at the lower end of the direction of the conveyance of the sheet of printing paper P, i.e., near the fixing unit 22, because the drive roller 27 is exposed to the greatest degree of heat from the fixing unit 22. The reason for so doing is that the roller radius of the drive roller 27 experiences the most significant thermal expansion, and thus, corresponding fluctuations in the rotational speed of the feeding belt 5 may be detected more quickly.

Figure 6:
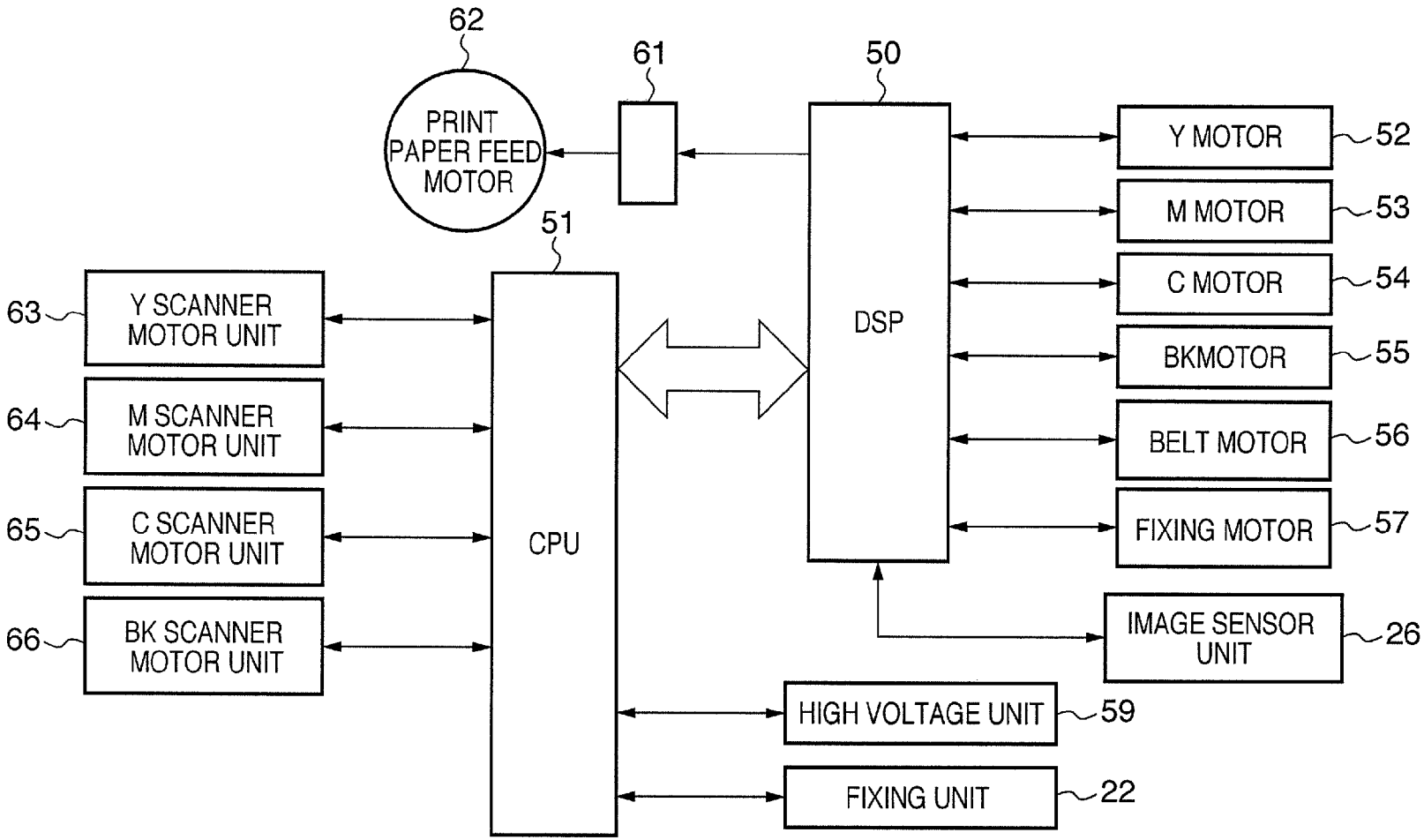
FIG. 6 is a block diagram describing a primary configuration of the image forming apparatus according to the embodiment of the present invention.

FIG. 6 is a block diagram illustrating a primary configuration of the image forming apparatus 1000, according to the embodiment of the present invention.

The image forming apparatus 1000 comprises a digital signal processor (DSP) 50, a CPU 51, drum drive motors 52 through 55, which drive the photosensitive drums 6 through 9 for each respective color, and a belt motor 56 of the feeding belt 5, which drives the drive roller 27. The image forming apparatus 1000 also comprises a fixing motor 57, which causes the fixing roller 22*a* of the fixing unit 22 to rotate, a printing paper feed motor 62, which causes the printing paper feed conveyor roller 29 to rotate, a printing paper feed driver 61, which controls the printing paper feed motor 62, scanner motor units 63 through 66, for each respective color, and a high-voltage power supply unit 59. The DSP controls the drum drive motors 52 through 55, the belt motor 56 of the feeding belt 5, the printing paper feed motor 62, and the image sensor unit 26, while the CPU 51 controls the scanner motor units 63 through 66, the high-voltage power supply unit 59, and the fixing unit 22. The DSP 50 controls the rotation of each motor by deriving the rotational speed of each motor from a detected speed signal from a speed detection MR sensor, and generating a PWM signal to bring the rotational speed of each motor in line with a target speed.

Figure 7:
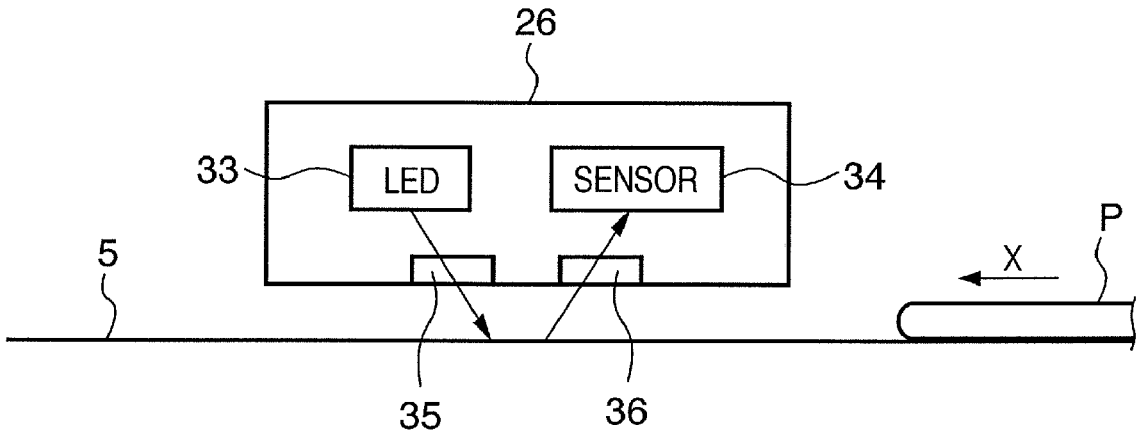
FIG. 7 depicts a view explaining a detection of an image, by an image sensor unit, on a belt.

FIG. 7 depicts a view explaining a detection of an image by the image sensor unit 26.

The image sensor unit 26, which is positioned in opposition to the feeder belt 5, comprises an LED 33, i.e., a light element, which shines light, and a CMOS sensor 34, i.e., a detection element, which detects light that is reflected from either the feeding belt 5 or the sheet of printing paper P. The CMOS sensor 34 is a two-dimensional area sensor. The light, whose source is the LED 33, irradiates at an angle on either the feeding belt 5 or the sheet of printing paper P, via a lens 35. The reflected light from the belt 5 or sheet P is collected via a focusing lens 36 and focused in the CMOS sensor 34, thus allowing detection of the image on either the feeding belt 5 or the sheet of printing paper P.

Figure 8:
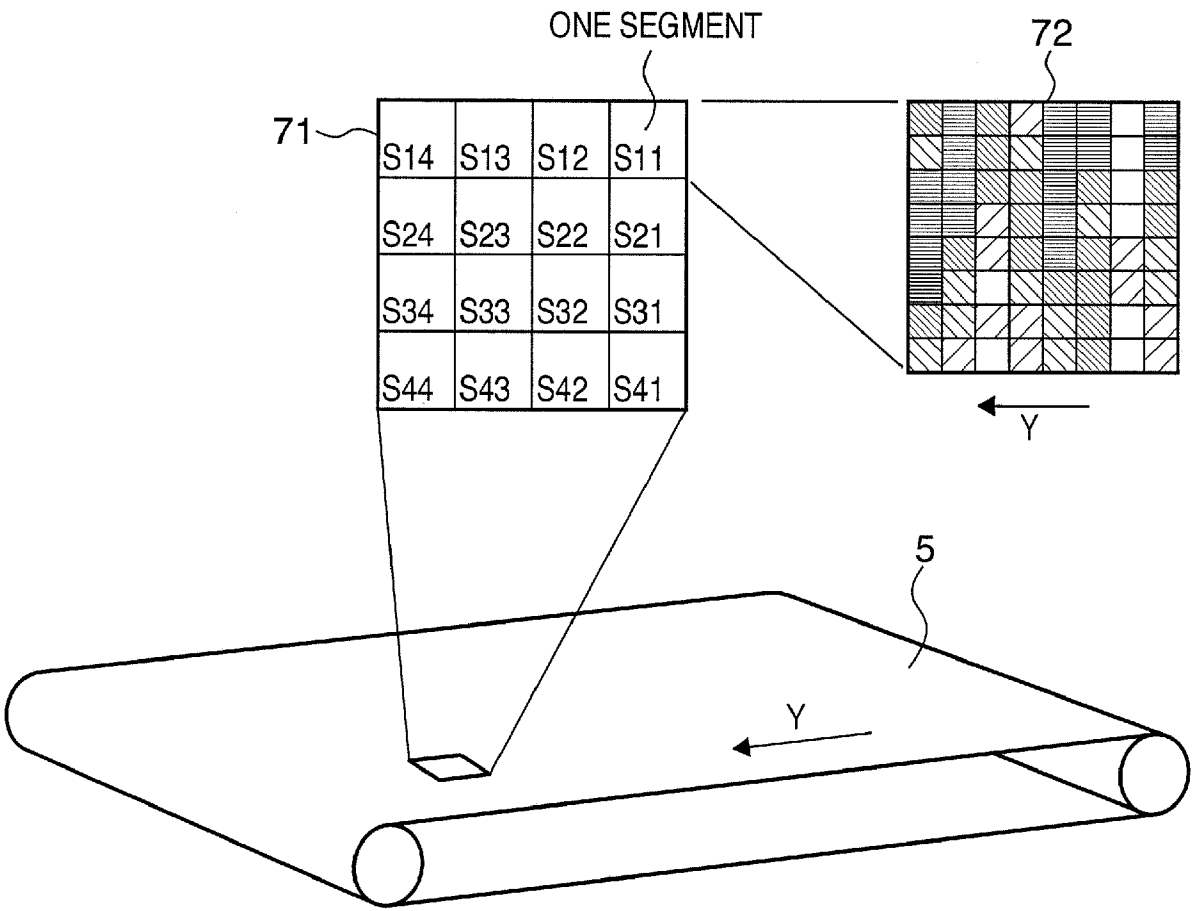
FIG. 8 depicts a view illustrating an image that is formed on a surface of a feeding belt, and a detection of the image by a sensor.

FIG. 8 depicts a view illustrating an image that is formed on a surface of the feeding belt 5.

As shown in FIG. 8, the image sensor unit 26, according to the embodiment, allows obtaining the image on the feeding belt 5 as an enlargement 71, which is enlarged by the focusing lens 36. The CMOS sensor 34 is configured of partitions of a plurality of sensor elements, as depicted in the enlargement 71. Reference numeral 72 denotes an example of an image of a segment S11 of the enlargement 71, wherein the CMOS sensor 34 detects the tone of the image. According to the embodiment, an image that the image sensor unit 26 scans is configured of a 4×4 arrangement of segments, employing the CMOS sensor 34, which has a resolution of 8×8 pixels per segment, and eight bits, i.e., 256 tones, per pixel. The configuration, i.e., eight-bit resolution, etc., is only an example; the present invention is not restricted thereto.

The surface of either the feeding belt 5 or the sheet of printing paper P may have a minute unevenness, because of such factors as scratches, dirt, or the fiber of the printing paper. Such unevenness generates shadows when the light shines thereupon at an angle, allowing detecting with ease a target pattern on the surface of either the feeding belt 5 or the sheet of printing paper 5.

It is possible to give enhanced characteristics to the scanned image by pre-applying the unevenness within an area of the surface layer of the feeding belt 5 that does not affect the control of the image transfer. It is also possible to detect the target pattern with the enhanced characteristics with the feeding belt 5, the surface of which is configured of a transparent substance, without affecting the image transfer, by pre-configuring a middle layer with either unevenness or a desired pattern.

Figure 9:
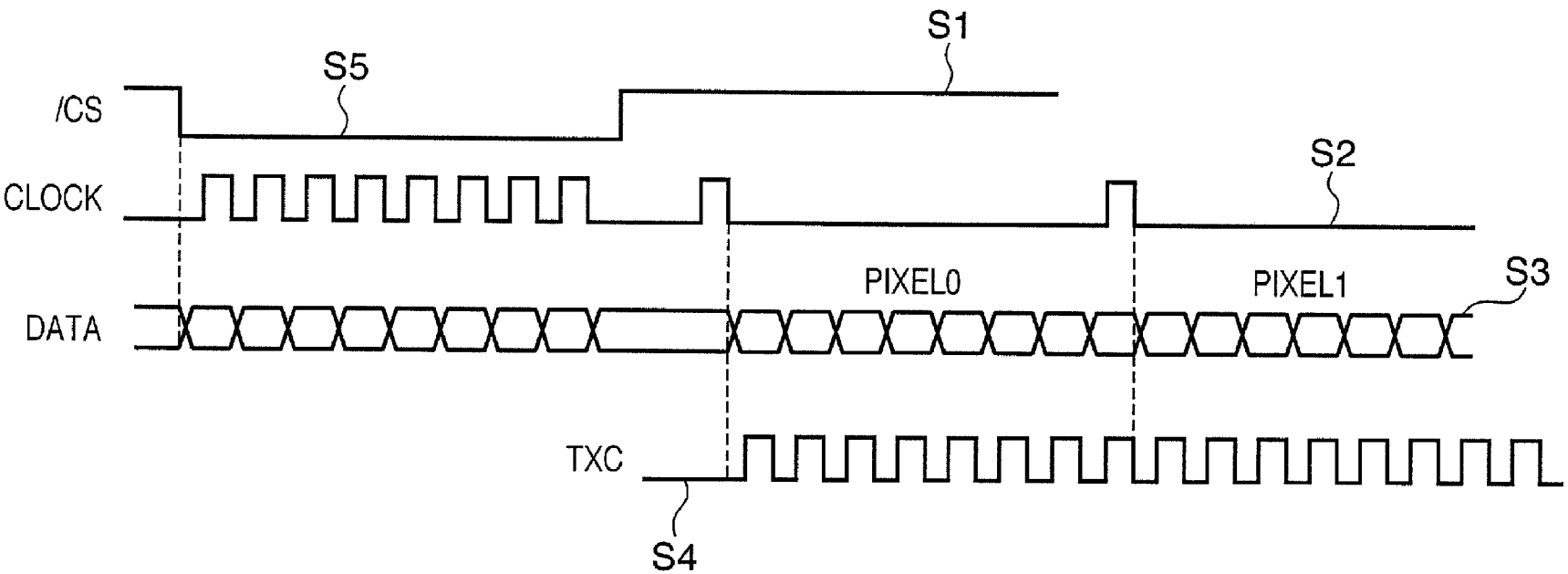
FIG. 9 is a timing diagram explaining an operation of an image sensor unit.
Figure 10:
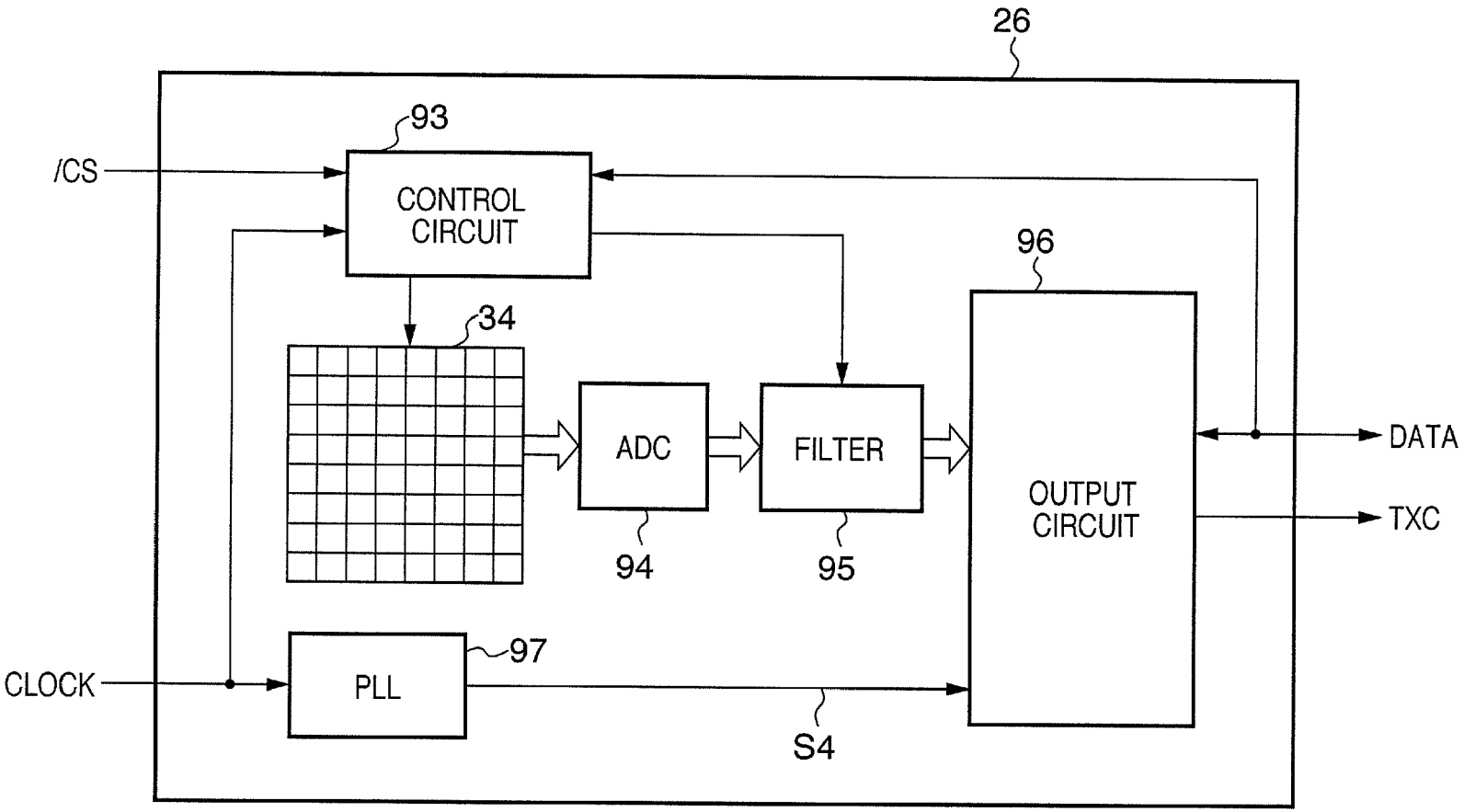
FIG. 10 is a block diagram illustrating a configuration of the image sensor unit according to the embodiment.

FIG. 9 is a timing diagram describing an operation of the image sensor unit 26. FIG. 10 is a block diagram illustrating a configuration of the image sensor unit 26.

The DSP 50 sets such control parameters as a designated number of filters for a control circuit 93 in FIG. 10, which uses a /CS signal, a clock signal S2, and a data signal S3, to control a serial communication for a segment selected of the CMOS sensor 34. In such a circumstance, as depicted in FIG. 9, S5, the DSP 50 sets the /CS signal to a low level, synchronizes the /CS signal with the clock as a transfer mode of the control parameter, and sends an eight-bit command, i.e., a control parameter, as data. Thus is the gain of the CMOS sensor 34 set to a filter circuit 95. The objective of the gain setting thereof is to adjust the gain to allow constant detection of an optimal image, because, for example, the image on the sheet of printing paper P has a higher reflectivity than the image on the feeding belt 5.

The DSP 50 adjusts the gain of the CMOS sensor 34 vis-á-vis the image that is scanned thereby, in order to facilitate implementation of the image comparison process, to be described hereinafter, with a high degree of accuracy. Implementation is achieved, for example, by controlling the gain of the CMOS sensor 34 vis-á-vis the scanned image until a given level of contrast is obtained.

As depicted in FIG. 9, S1, the DSP 50 sets the /CS signal to a high level, and sets the transfer mode of image data from the CMOS sensor 34. In such a circumstance, an output circuit 96 sends digital image data that is supplied form the output of the CMOS sensor 34, via an A/D converter 94 and the filter circuit 95, to the DSP 50, in pixel order, in synchronism with the CLOCK signal. In such a circumstance, a transmission synchronization clock TXC, depicted in FIG. 9, S4, is generated by a PLL circuit 97, in accordance with the clock signal 52. Consequently, the DSP 50 receives the respective 8×8 pixel data per segment that is outputted by the image sensor unit 26 in order, i.e., PIXEL0, PIXEL 1, etc.

The following is a description of a method of computing a segment change of the CMOS sensor 34, as well as a relative distance of either the feeding belt 5 or the sheet of printing paper P. The computation of the relative distance is executed by the DSP 50.

FIGS. 11A through 13C describe a configuration of the CMOS sensor 34 and the movement of the image being scanned in a predetermined sampling period (t2–t1), each at a different speed. The column address is assigned to the moving direction Y of the feeding belt 5, and the row address to the direction X that is orthogonal thereto.

Figure 14:
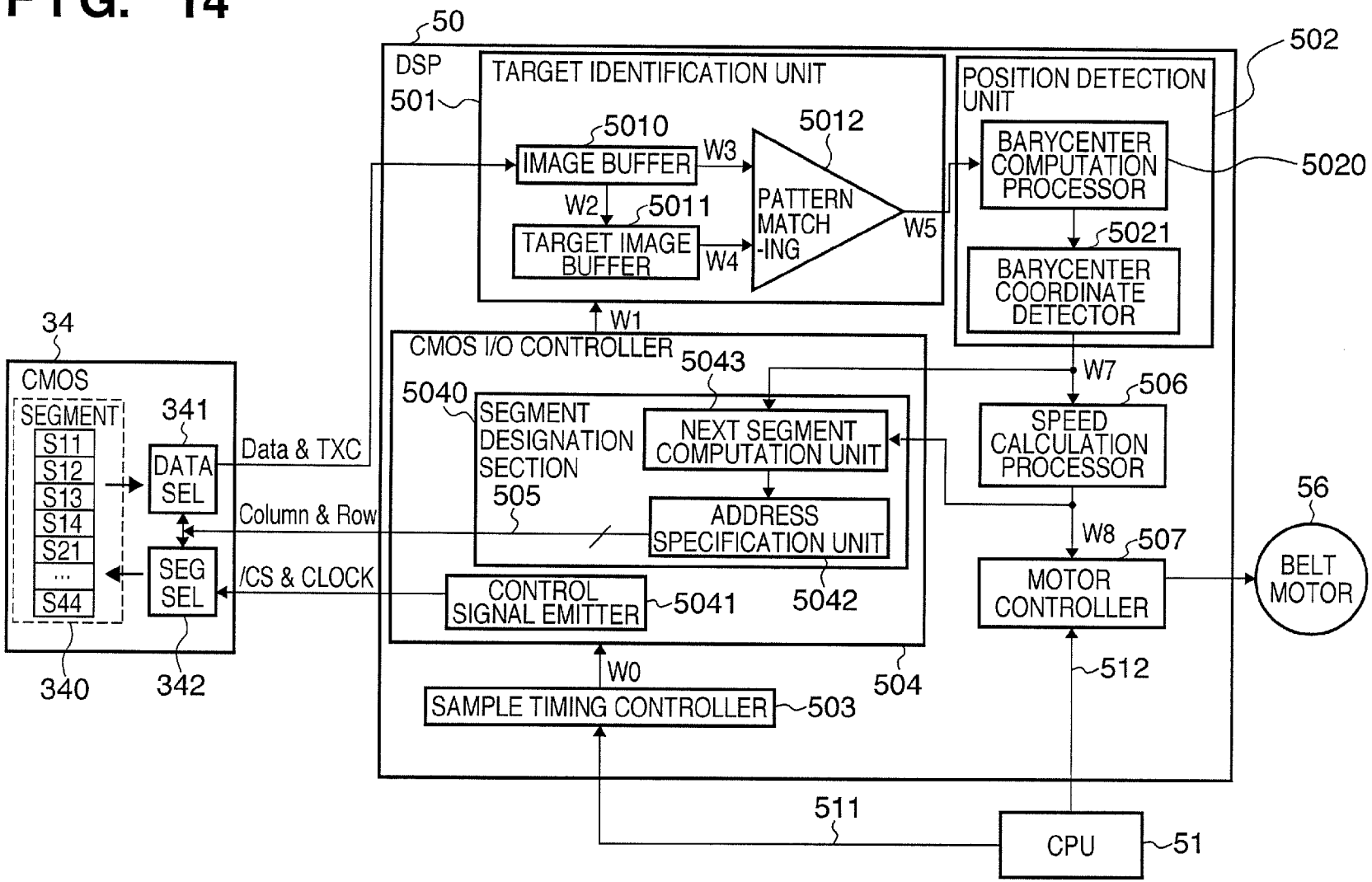
FIG. 14 is a functional block diagram illustrating a configuration of a function of a DSP that detects and controls a CMOS sensor signal, according to the embodiment.

FIG. 14 is a function block diagram illustrating a configuration of a function of the DSP 50 that detects and controls a signal of the CMOS sensor 34, according to this embodiment. The major areas of the configuration may be broken down into the CMOS sensor 34, the DSP 50 that performs the control and data processing thereof, the CPU 51, and the belt motor 56.

The CMOS sensor 34 is configured of a plurality of segments 340, as per the foregoing, which are S11 through S14, S21 through S24, S31 through S34, and S41 through S44 in the example depicted in FIG. 8. The control signals for each respective segment, i.e., CS, CLOCK, DATA, and TXC, are connected via selectors (SEL) 3341 and 342, each of which inputs or outputs the control signal from the DSP 50 to the designated segment, according to the column and row address supplied from the DSP 50. The DSP 50 receives a speed command 512 of the belt motor 56 and a sampling rate command 511 of the image from the CPU 51 and performs rotational control of the belt motors 56, and image sampling, in response to the designated commands.

The DSP 50 possesses a target identifier 501, which identifies the target pattern from the scanned image, and a position detector 502, which detects the position of the target pattern that the target identifier 501 identifies. The DSP 50 also possesses a CMOS I/O controller 504, which performs handling of signals between the DSP 50 and the CMOS sensor 34, a speed computation unit 506, which derives the speed at the surface of the feeding belt 5, and a motor controller 507, which controls the rotational speed of the belt motor 56.

The CPU 51 directs the motor controller 507 concerning the rotational speed of the belt motor 56, which drives the conveyance of the feeding belt 5 at the rotational speed thus directed. The directed rotational speed corresponds to an assumption speed. A sampling timing controller 503 informs the I/O controller 504 of a sampling timing W0, according to the sampling rate command 511 that has been issued by the CPU 51. A Ctrl signal generator 5041 of the I/O controller 504 outputs each respective control signal, i.e., /CS and CLOCK, to the CMOS sensor 34, at the informed sampling timing W0. A column and row address 505, which is determined by a segment designation section 5040, is also outputted to the CMOS sensor 34.

The following is a description of the segment designation section 5040.

An address designation section 5042 output an address used for an initial determination of the target pattern as the column and row address.

FIGS. 11A through 11D depict views explaining an example of the movement of an image being scanned by the CMOS sensor 34.

Figure 11A:
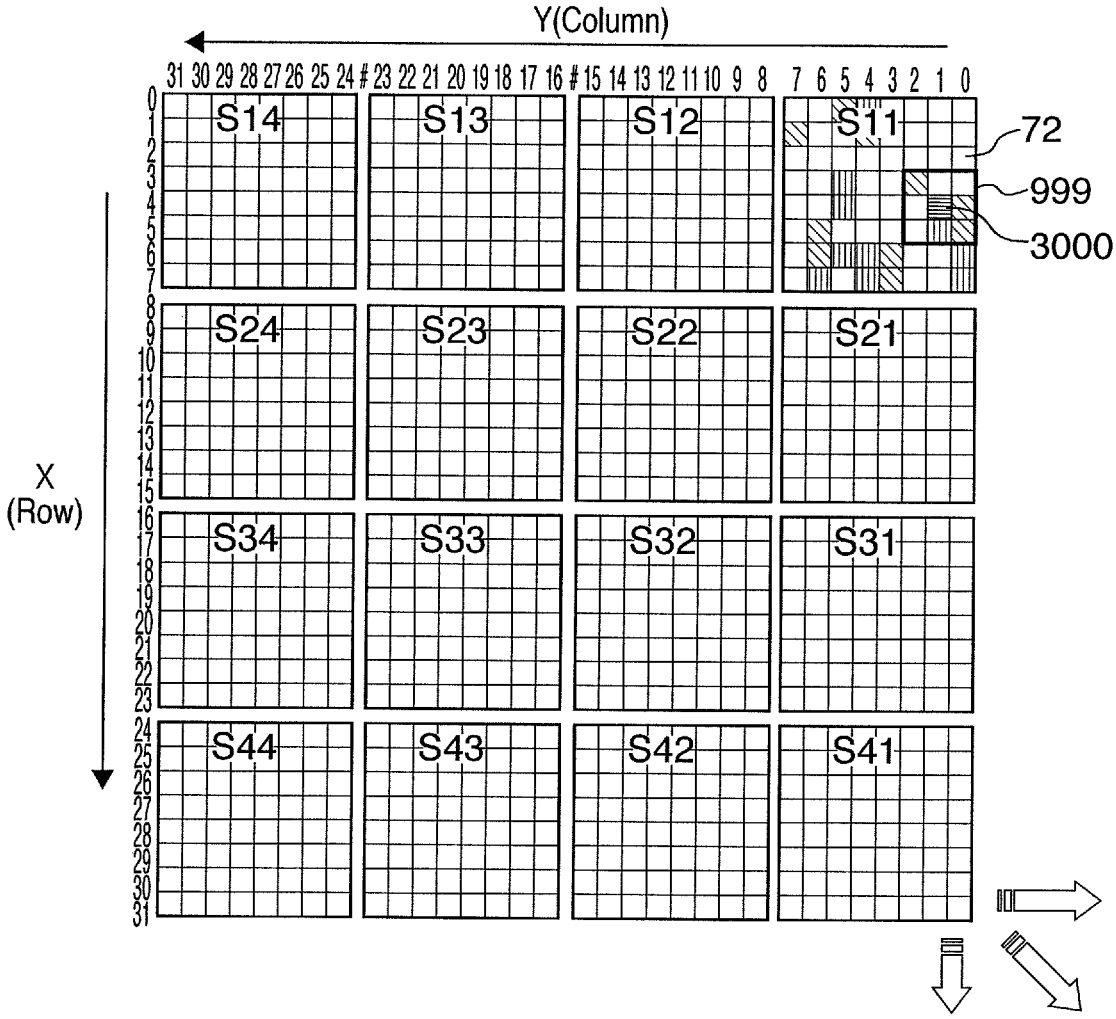
FIGS. 11A through 11D, FIGS. 12A through 12C, and FIGS. 13A through 13C depict views explaining an example of the movement of an image being scanned in a predetermined sampling interval (t2−t1), each at a different speed.
Figure 11:
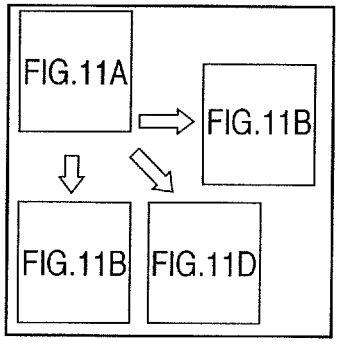

FIGS. 11A through 11D treat as the target pattern a pattern that is included in an image that is detected in segment S11. The barycentric position of the pattern in FIG. 11A, in (column, row) coordinates, is (1, 4). FIG. 11A depicts the image that the CMOS sensor 34 scans at the time t1, which is buffered in an image buffer 5010 of the target identifier 501 at a sampling timing signal from the I/O controller 504 and a target area information W1. An area W2, which may be designated, of the pattern that is buffered in the image buffer 5010 is buffered in a target image buffer 5011, as a target pattern 999. A pattern matching section 5012 performs a pattern match between a pattern W3, which is buffered in the image buffer 5010, and a target pattern W4, which is buffered in the target image buffer 5011, at the next sampling timing. An evaluation is made thereby as to whether or not the pattern W3, scanned at the next sampling timing, includes the target pattern. If the target pattern cannot be identified, a comparison is made again in the pattern matching section 5012 by shifting the data in the image buffer 5010 one pixel at a time, as the sampling pattern W3. The process is repeated, with pattern matching performed, until either a match with the target pattern is found, or a predetermined number of iterations has occurred; an error may be flagged if no match has been found after the predetermined number of iterations. If the target pattern can be thud identified, the position detector 502 is notified of an address information W5 of the target pattern.

The position detector 502 is configured of a barycentric position computation unit 5020 and a barycentric coordinate detector 5021, and notifies the speed computation unit 506 of the address information W5, and barycentric coordinates W7, of the target pattern.

The example depicted in FIG. 11A denotes a notification of a position (1, 4), in (column, row) format, of a barycenter 3000 from the address information (0 to 2, 3 to 5) of the target pattern 999, i.e., a 3×3 pixel region. While the barycenter 3000 is treated as the central coordinates (centroid) of the target pattern 999 according to the embodiment, the present invention is not limited thereto; it would be permissible, for example, to treat the center of the density in the pattern as the barycenter instead.

The speed computation unit 506 stores the position (1, 4), in (column, row) format, of the barycenter 3000 in memory as a first sampling barycenter position d1. A surface speed V21 is computed from the position of the barycenter 3000 at a second sampling, which is derived in a similar manner, at the next sampling.

Figure 11B:
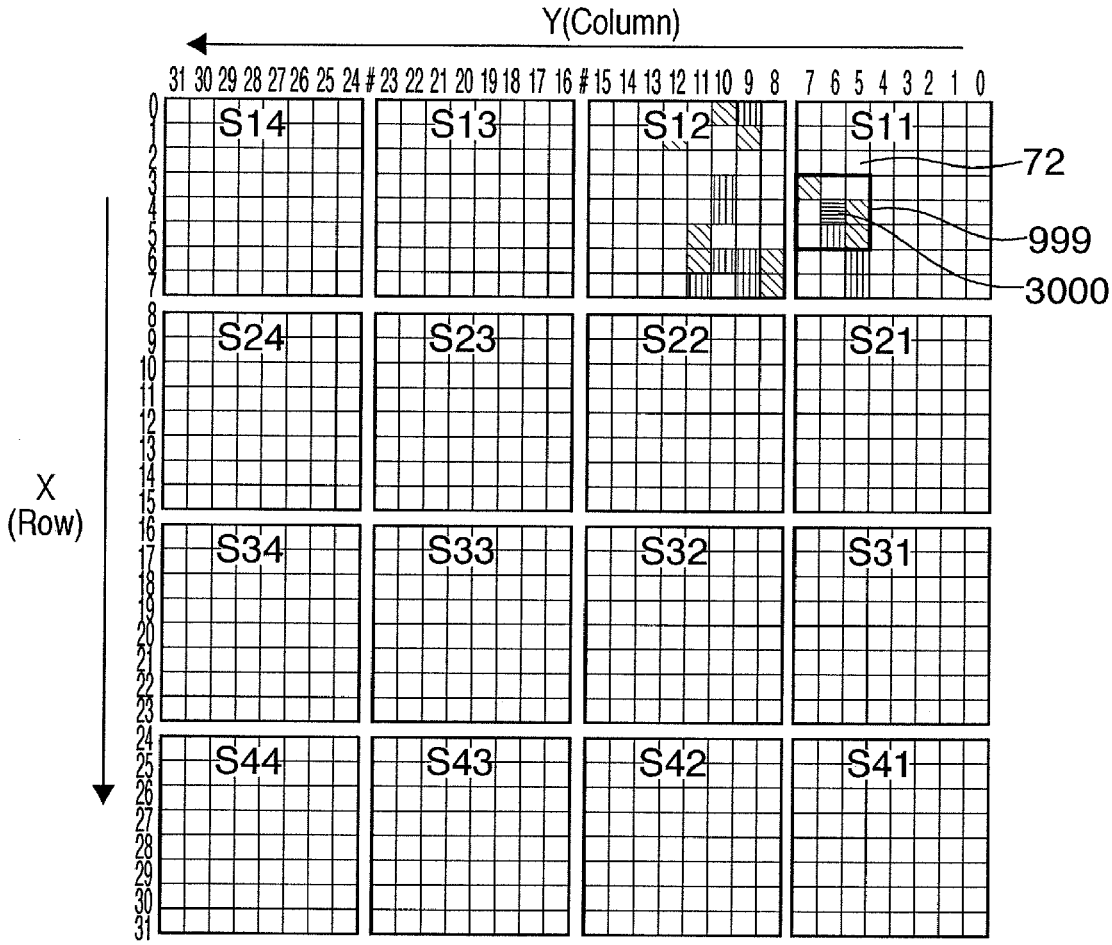

FIG. 11B depicts an image that is detected in the second sampling, at the time t2, with a position d2 of the barycenter 3000 being (6, 4), again, in (column, row) format. In such a circumstance, it is possible to derive a moving speed W8 as follows:

$$W8=\Delta d/\Delta t$$

$$=(d2-d1)/(t2-t1)=(6-1)/(t2-t1)$$

$$=5/(t2-t1).$$

If the present target pattern 999 is further identified in the direction of the Y-axis hereinafter, the position d2 of the barycenter 3000 in the second sampling is treated as the position d1 of the barycenter 3000 in the first sampling, where d1≦d2. If a new target pattern is detected with the segment S11, the positions d1 and d2 of the barycenter are both reset to zero, and the foregoing process is repeated. The target pattern 999 is updated when it is possible to predict that the maximum numerical value of the column in the moving direction, 32, in the present instance, will be exceeded.

According to the embodiment, the target pattern is updated when the target pattern 999 exceeds a column address of (31−αz), where α is the size of the error in speed plus the size of the target pattern. The target pattern may thus be updated when it is predicted that it will not be possible to identify the target pattern in any of the segments S114, S24, S34, or S44. According to the embodiment, if speed is 5 and α is 4, the column address is 27, i.e., 31−4. Accordingly, it will be possible to contiguously select the speed without updated the target pattern 999 up to 27/5, or 5.4, i.e., until a time t5.

The following is a description of a segment designation process.

FIG. 11B depicts a surface pattern on the feeding belt 5 at the time t2, when the moving speed W8 that is outputted by the speed computation unit 506 is 5, i.e., the target pattern is moved by five pixels in the column direction between the time t1 and the time t2. According to the embodiment, the position of the barycenter 3000 at the time t2 is (6, 4), again, in (column, row) format, with the barycenter 3000 being positioned upon the segment S11, which must be pre-selected if the target pattern 999 is to be identified at the time t2. Consequently, the segment designation section 5040 performs the process of predicting the position of the target pattern at the next sampling.

The segment designation section 5040 of the I/O controller 504 is notified of the moving speed W8. The moving speed W8 also corresponds to an assumption speed. A segment computation unit 5043 determines the segment wherein the target pattern 999 is positioned at the next timing from the moving speed W8 and the position W7 of the barycenter 3000 of the target pattern.

Given, in FIG. 11B, that the moving speed W8 is 5, and the position W7 of the barycenter 3000 at the time t1 is (1, 4), in (column, row) format, it is predicted that the position W7 of the barycenter 3000 at the time t2, i.e., the next sampling timing, will be (5+1, 4), again, in (column, row) format. The address 505 thus predicted, i.e., (6, 4), again, in (column, row) format, is sent from the address designation section 5042 to the CMOS sensor 34. The segment S11, which contains the address (6, 4), is thus made effective, allowing detection of the target pattern 999 therein.

While the configuration in FIG. 14 derives the next segment to be examined from the address information W5 of the target pattern 999, it would be permissible instead to computer the next segment to be examined from the speed command 512 that is sent by the CPU 51, a speed correction issued by the motor controller 507, or all of the above. The speed designated by the speed command 512 and the corrected speed are also corresponding to an assumption speed. Repeated execution of the foregoing process allows real-time detection of the surface speed of the feeder belt 5.

The moving speed W8 of the feeder belt 5 on the image forming apparatus 1000 switches according to the type, i.e., the thickness, of the sheet of printing paper, in order to improve image quality, including the fixing characteristic of the image thereupon, i.e., the thicker the sheet of printing paper, the slower the speed. In the configuration according to the embodiment, the detection of the speed of the feeder belt 5 is detected across a wide range, from slow to fast speeds. FIG. 11B depicts a comparatively slow moving speed, i.e., a very thick sheet of printing paper mode, vis-á-vis the detectable area of one segment of the CMOS sensor 34. By contrast, FIG. 11C depicts a medium moving speed of the feeder belt 5, i.e., a thick sheet of printing paper mode, and FIG. 11D, a fast moving speed of the feeder belt 5, i.e., a typical sheet of printing paper mode.

Medium Moving Speed (Thick Sheet of Printing Paper Mode)

Figure 11C:
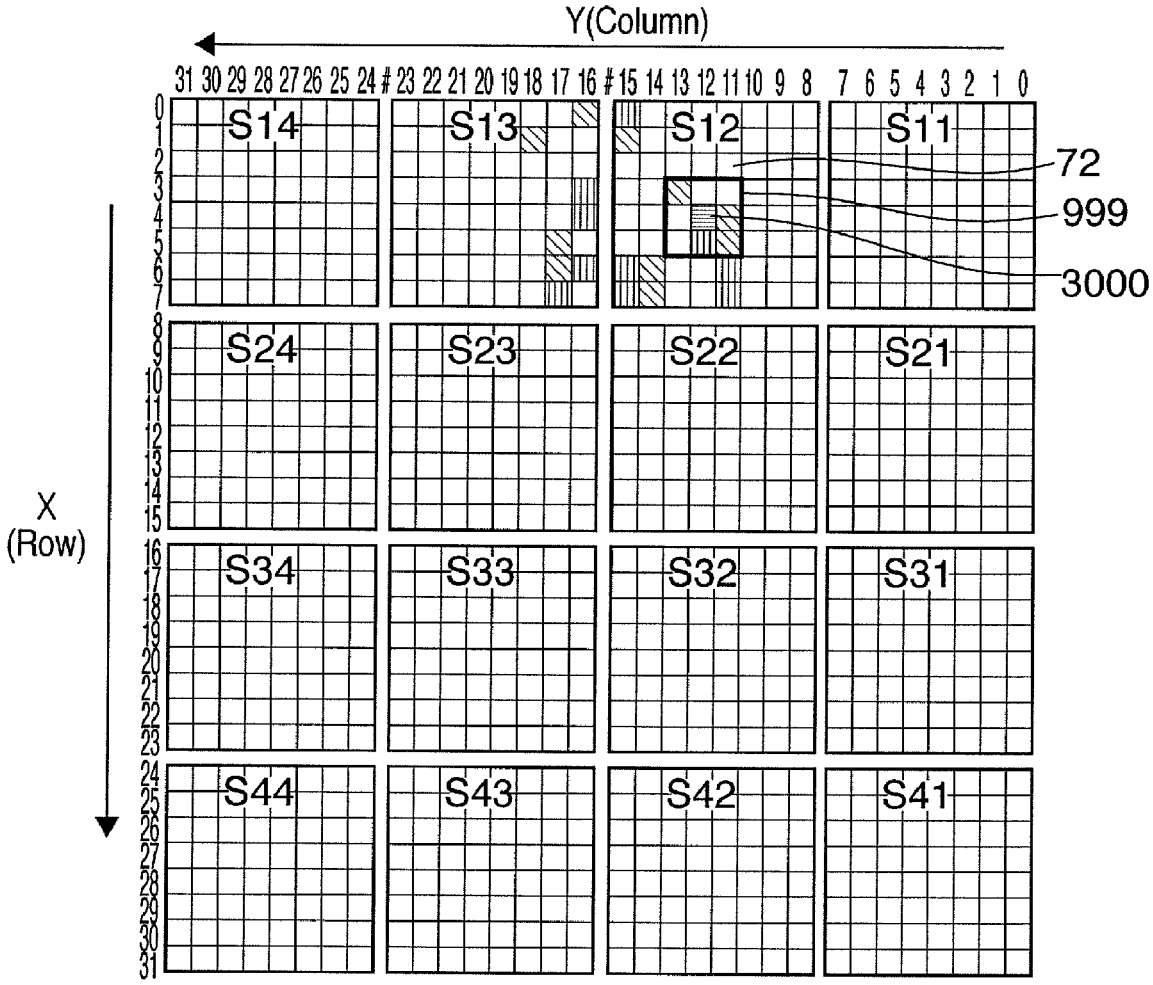

FIG. 11C depicts a pattern upon the feeder belt 5 at the time t2 when the moving speed W8 thereupon is 10. In FIG. 11C, the target pattern 999 at the time t2 is predicted to be positioned at address (1+10, 4), again, in (column, row) format, as per the foregoing, and segment S12 is made effective. The position of the barycenter 3000 that is actually obtained is (12, 4), again, in (column, row) format, and the speed detection value, i.e., the distance, is 11, i.e., =12-1. A speed detection error of 1 is thus detected. The speed detection error is applied to a correction in the motor controller 507 of the rotational speed of the belt motor 56, i.e., the speed command 512 that is issued from the CPU 51 reduces the speed thereof. Thus, the position of the barycenter 3000 of the target pattern 999 at the sampling timing, t3, is predicted to be (12+10−1, 4), or (21, 4), again, in (column, row) format, and the segment S13 that includes the position (21, 4) is made effective. If the rotational speed of the belt motor 56 is not immediately corrected, it is permissible to predict that the position of the barycenter 3000 is (12+10, 4) again, in (column, row) format. The target pattern 999 at a next sampling timing, t4, commences with the updating of the target pattern 999, as either exceeding the maximum column value of 31, or being the effective segment S11, owing to a narrow margin.

Fast Moving Speed (Plain Sheet of Printing Paper Mode)

Figure 11D:
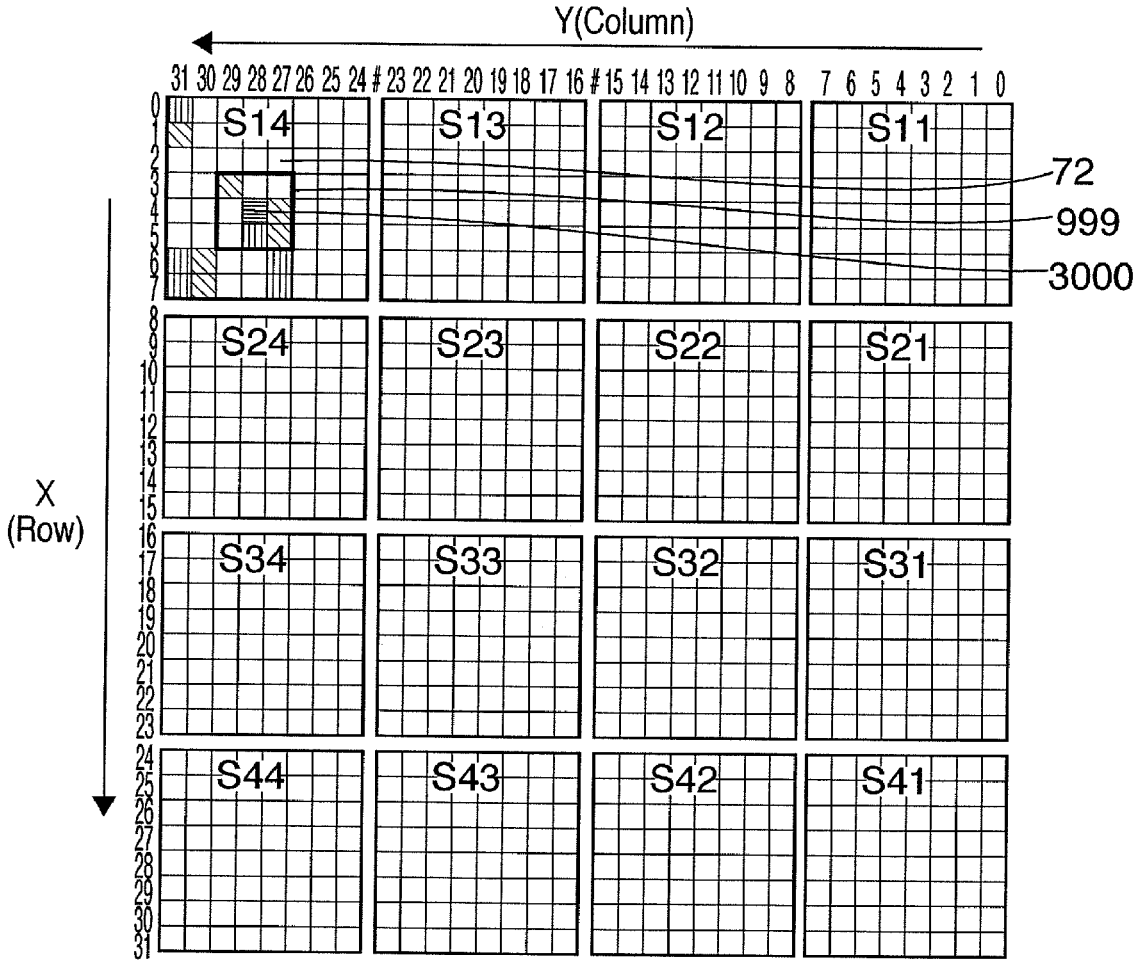

FIG. 11D depicts a pattern upon the feeder belt 5 at the time t2 when the moving speed W8 thereupon is 28. In FIG. 11D, the target pattern 999 at the time t2 is predicted to be positioned at address (1+28, 4), again, in (column, row) format, as per the foregoing, and segment S14 is made effective. The position of the barycenter 3000 that is actually obtained is (28, 4), again, in (column, row) format, and the speed detection value, i.e., the distance, is 27, i.e., =28−1. The speed error is thus −1. The speed error is applied to a correction in the motor controller 507 of the rotational speed of the belt motor 56, i.e., the speed command 512 that is issued from the CPU 51 increases the speed thereof by 1. Thus, the target pattern 999 at the next sampling timing, t3, is predicted to exceed the maximum column value of 31, the next effective segment will be S11, and the process commences with the updated of the target pattern 999.

Figure 12A:
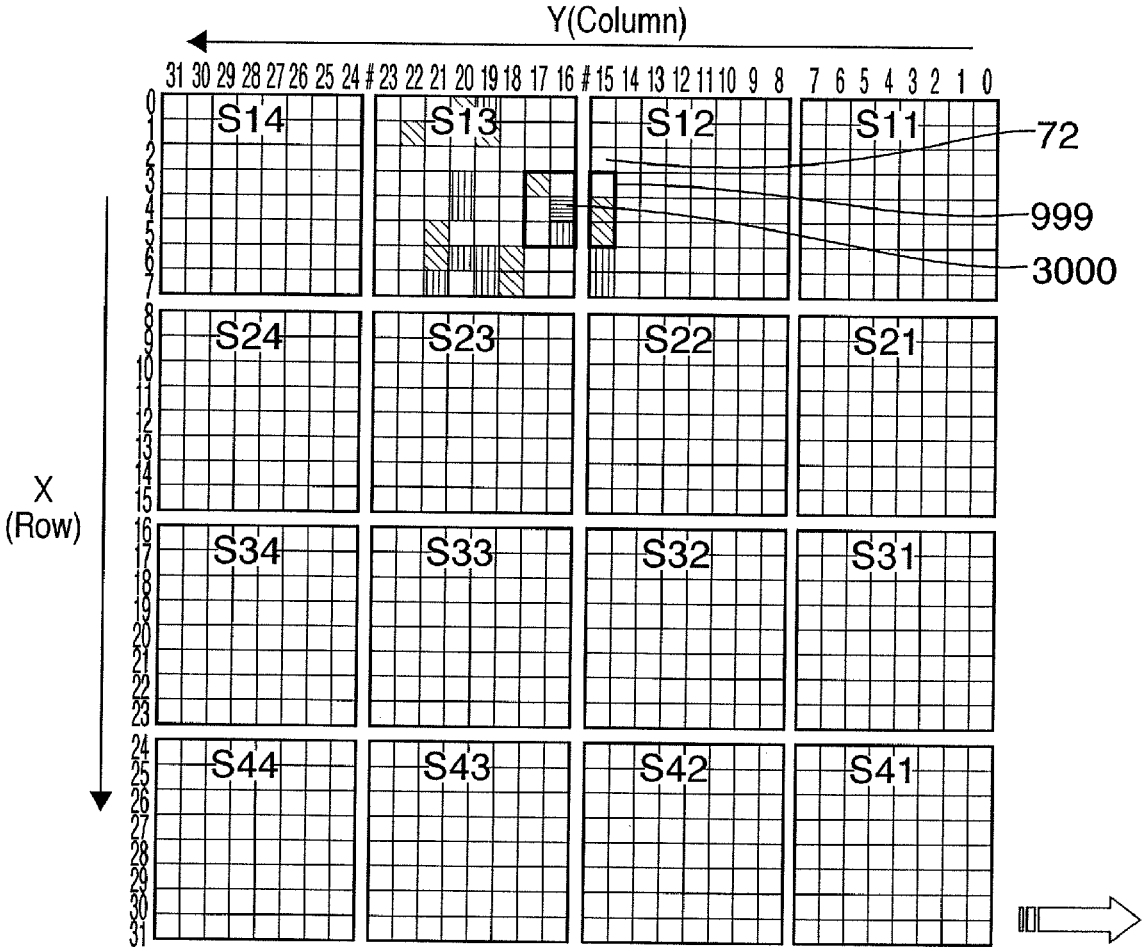
Figure 12:
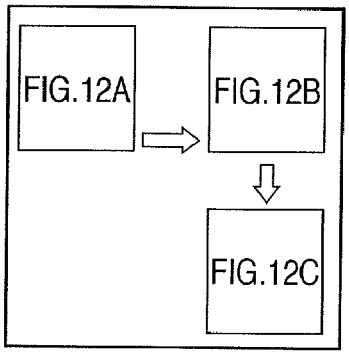
Figure 12B:
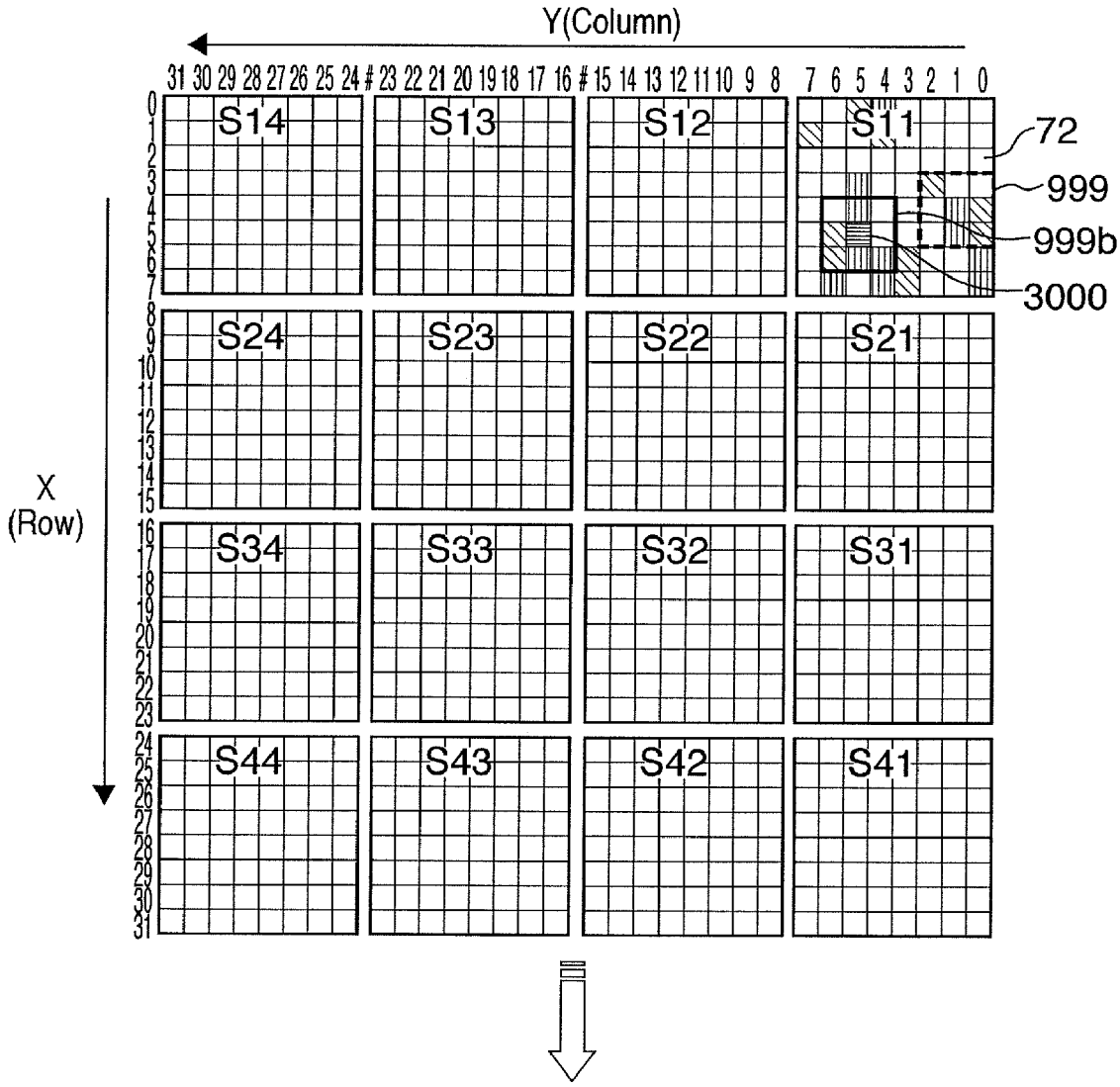
Figure 12C:
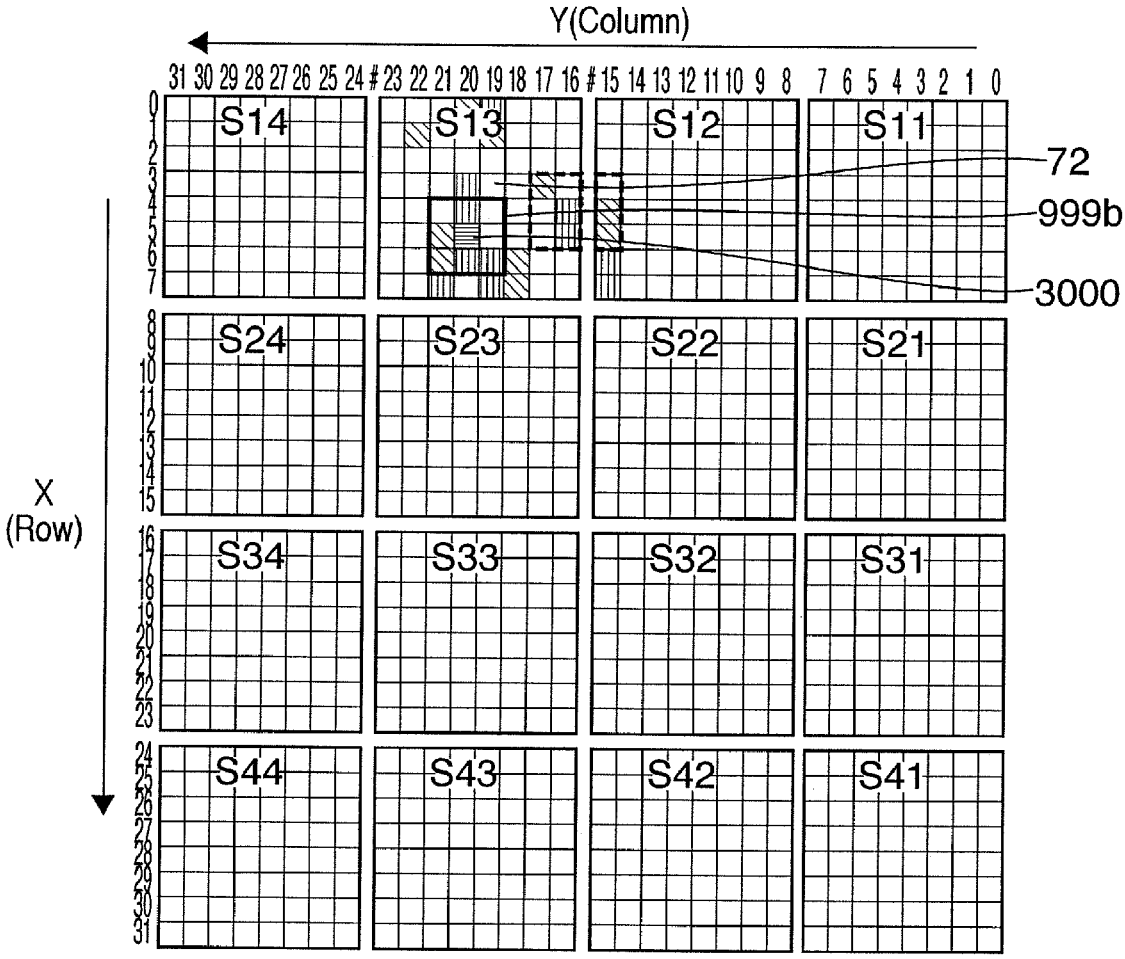

FIGS. 12A through 12C depict views illustrating examples of a circumstance wherein the target pattern 999 spans two segments.

FIG. 12A depicts a pattern upon the feeder belt 5 at the time t2 when the speed W8 of a transition command thereupon is 15, given the foregoing configuration of one segment comprising 8×8 pixels. The target position 999 spans segments S12 and S13 in the present circumstance. Identifying the target pattern thus requires making two segments effective simultaneously. Doing so, however, raises the possibility that the target pattern 999 would be lost, owing to the relation between the scope of the detection area and the processing speed. The following are depictions of two examples of processing in such a circumstance:

1. Changing the Area that Determines the Target Pattern In the first example wherein the target pattern 999 is predicted to cross over into the next segment, the detection area of the target pattern is changed.

As depicted in FIG. 12B, for example, the area of determination is changed form an area of the target pattern 999 of (0 to 2, 3 to 5), in (column, row) format, to an area of a target pattern 999*b* of (4 to 6, 4 to 6), again, in (column, row) format. Thus, the target pattern 999*b* at the time t2 may be evaluated as being positioned only within the segment S13 at the time t2 when the speed W8 of transition command is 15, as depicted in FIG. 12C. The determination of the area that evaluates the target pattern 999*b* is shifted from the initially predicted position (16, 4) of the target pattern 999 at the time t2 so as to span the segments, and derived by counting the timing t1 backwards from the speed W8 of transition command. It is presumed that a criterion for evaluating whether or not the target pattern 999 crosses over into the next segment includes a margin of a plurality of pixels.

2. Overlapping Segment Configurations

The following is a description of the second example, a configuration wherein the segments overlap with each other.

Figure 13A:
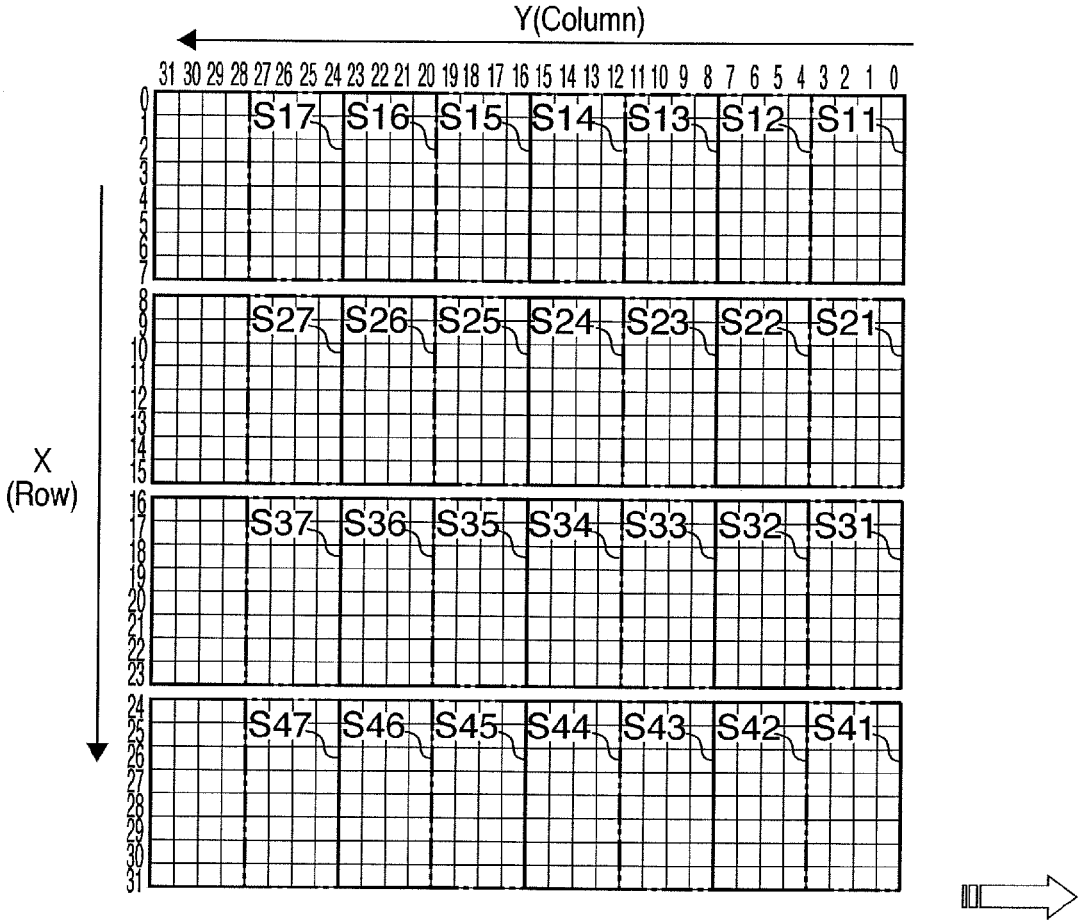
Figure 13:
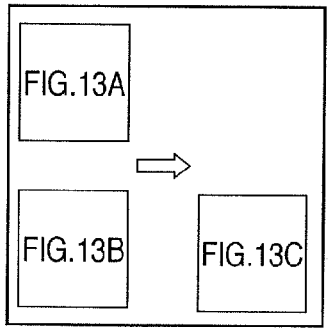

As depicted in FIG. 13A, the number of pixels that configure each respective segment is 8×8, as per the preceding examples. Segment S11 is the solid line in FIG. 13A, (0 to 7, 0 to 7), in (column, row) format, segment S12 is the dashed line (4 to 11, 0 to 7), again, in (column, row) format, segment S13 is the solid line (8 to 15, 0 to 7), again, in (column, row) format, etc. Each segment thus overlaps halfway, i.e., by four pixels, with its predecessor in the column orientation, such that the number of segments is increased from S11 through S17, and S21, etc., through to S47.

Figure 13B:
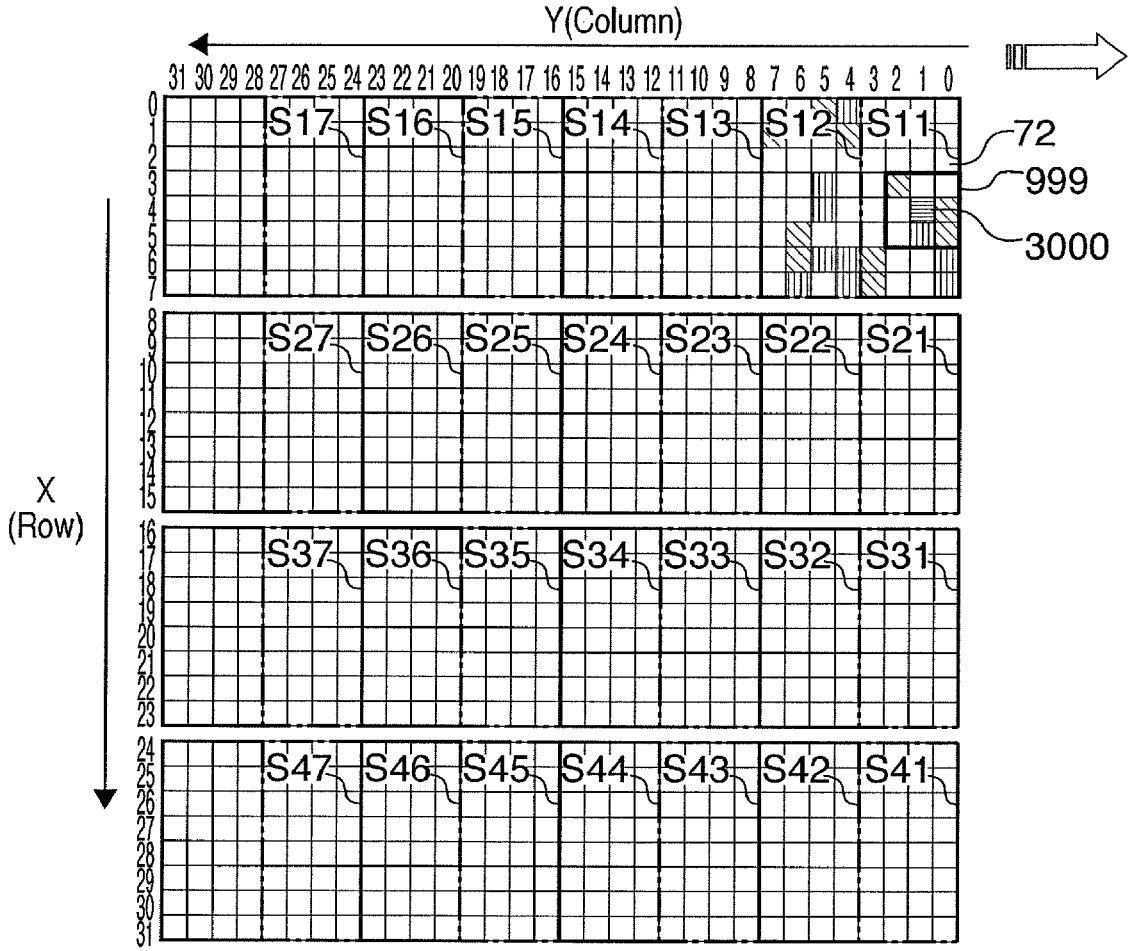

FIG. 13B depicts a surface pattern on the feeding belt 5 at the time t1 in such a circumstance. The barycenter of the target pattern 999 is determined to be (1, 4), in (column, row) format.

Figure 13C:
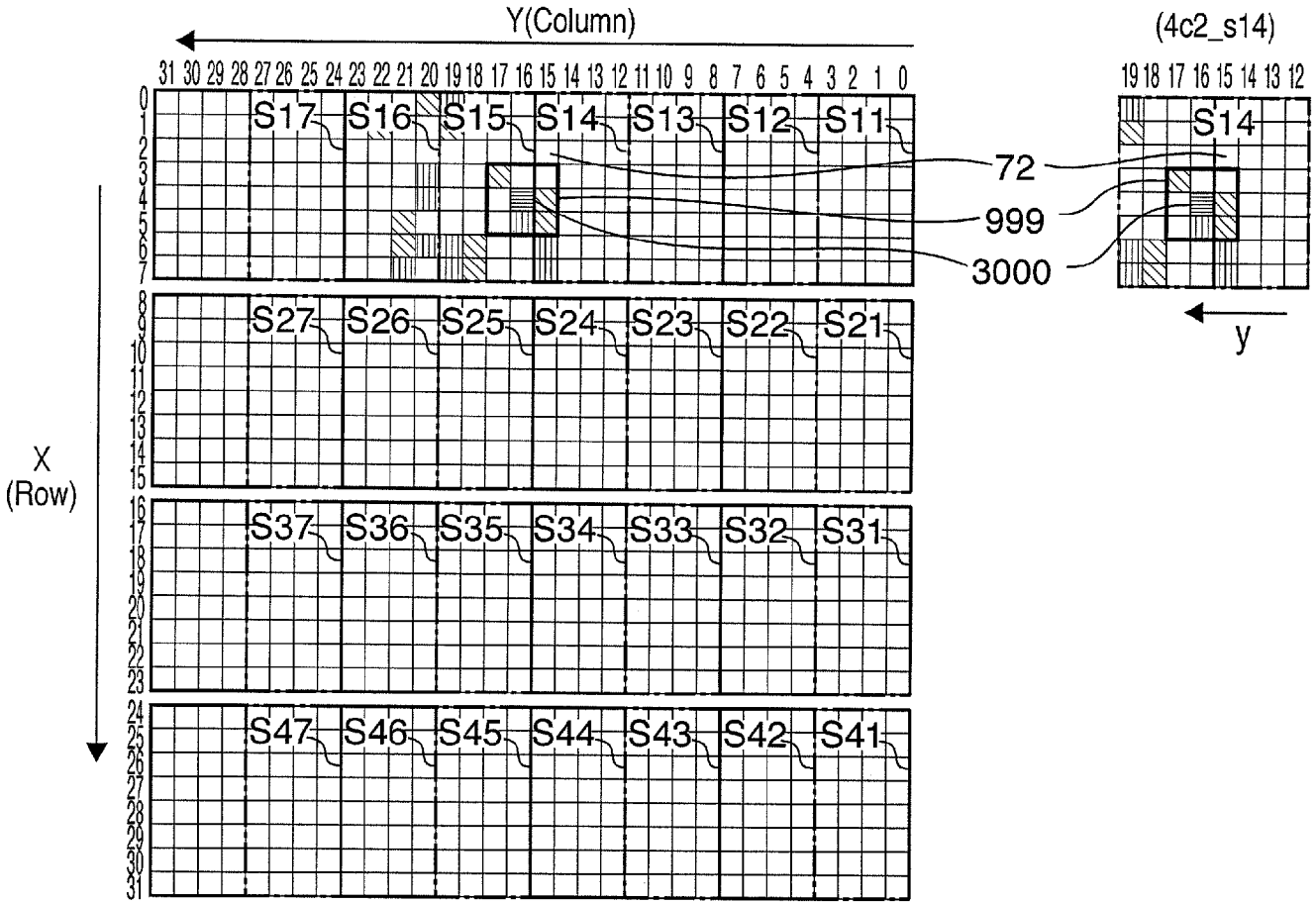

FIG. 13C depicts a surface pattern on the feeding belt 5 at the time t2 when the speed W8 of transition command is 15. It is predicted in FIG. 13C that the position of the barycenter of the target pattern 999 at the time t2 is (1+15, 4), in (column, row) format.

As depicted in FIG. 13C, making the segment S14 effective, at (8 to 15, 0 to 7), in (column, row) format, wherein the target pattern 999 does not span a plurality of segments, allows definite identification of the target pattern 999.

While it is presumed according to the embodiment that the scope of overlap between segments is half a segment in the column orientation, the present invention is not restricted thereto in either the orientation or the scope of the overlap.

The following is a description of a process of the DSP 50 and the CPU 51 controlling the image forming apparatus, according to the embodiment.

Figure 15:
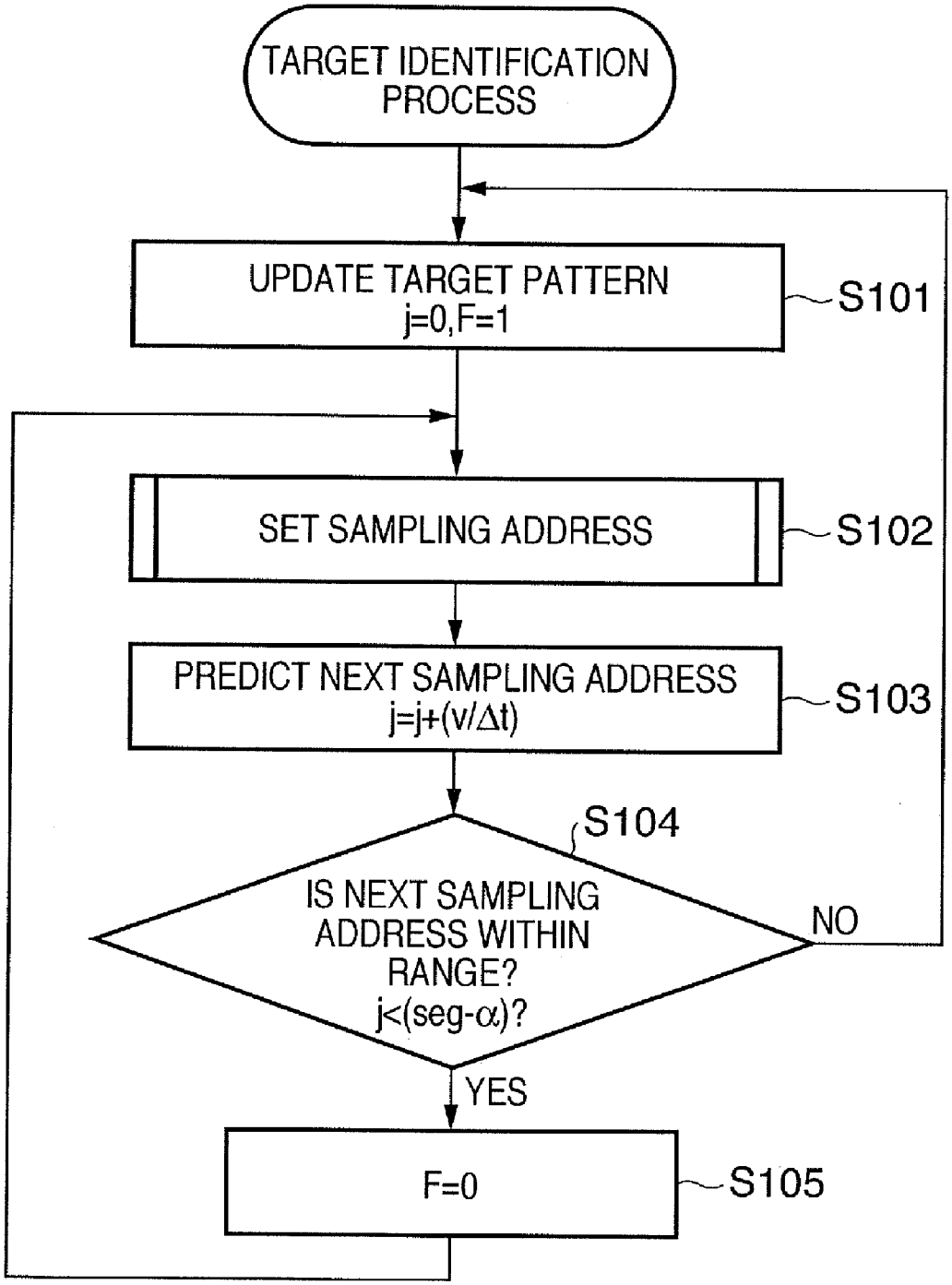
FIG. 15 is a flowchart explaining a process of the DSP identifying a target pattern, according to the embodiment.

FIG. 15 is a flowchart explaining a process of the DSP 50 identifying a target pattern, according to the embodiment, which corresponds to the foregoing process carried out by the target identifier 501. A program that executes the process is stored in a program memory (not shown) of the DSP 50. First, is a description of variables that are used in the process. F denotes a sampling initialization flag, which signifies that the target pattern is not updated when set to zero, and that the target pattern is updated when set to 1, j denotes the address that is being sampled in the column orientation, i.e., the Y-axis, and seg denotes the maximum value of the column address, 32, in the foregoing example. V denotes the speed of transition that is commanded in the column orientation, Δt denotes an interval for sampling, and a denotes the margin of the distance. These variables and the flag are stored in a RAM (not shown) of the DSP 50.

The target pattern is updated in step S101. The variable j of the sampling address is set to zero, and the flag F that denotes whether or not the pattern has been updated is set to 1. The process proceeds to step S102, wherein the address of the barycenter of the target pattern in the column orientation is set to the sampling address j. The process proceeds to step S1103, wherein the next sampling address j is computed and predicted from a speed command value v (512) and a sampling rate command value Δt (511). In the present circumstance, the formula is $j=j+(v/\Delta t)$. The process proceeds to step S104, wherein the next sampling address j, which was computed in the previous step S103, is evaluated as to whether or not it falls within the detection range of the CMOS sensor 34, i.e., whether it is less than the upper bound of the address (seg). As previously described, it would be permissible to set the margin a to take the speed error or another factor into account, i.e., $j<(seg-\alpha)$. If the result of the evaluation in step S104 is in the negative, i.e., $j>(seg-\alpha)$, it signifies that the target pattern 999 is transitioning outside the range of the CMOS sensor 34, causing the process to return to step S101, and to repeat the process described therein of determining the target pattern 999.

If the result of the evaluation in step S104 is in the negative, i.e., $j<(seg-\alpha)$, the process proceeds to step S105, wherein the target pattern 999 at the next sampling timing is determined to be within the detectable range of the CMOS sensor 34. The pattern update flag F is set to zero in order that the target pattern is updated. The process then proceeds to step S102, wherein the next sampling address that is computed is set. The target identifier 501 thus repeats the execution of the foregoing process.

Figure 16:
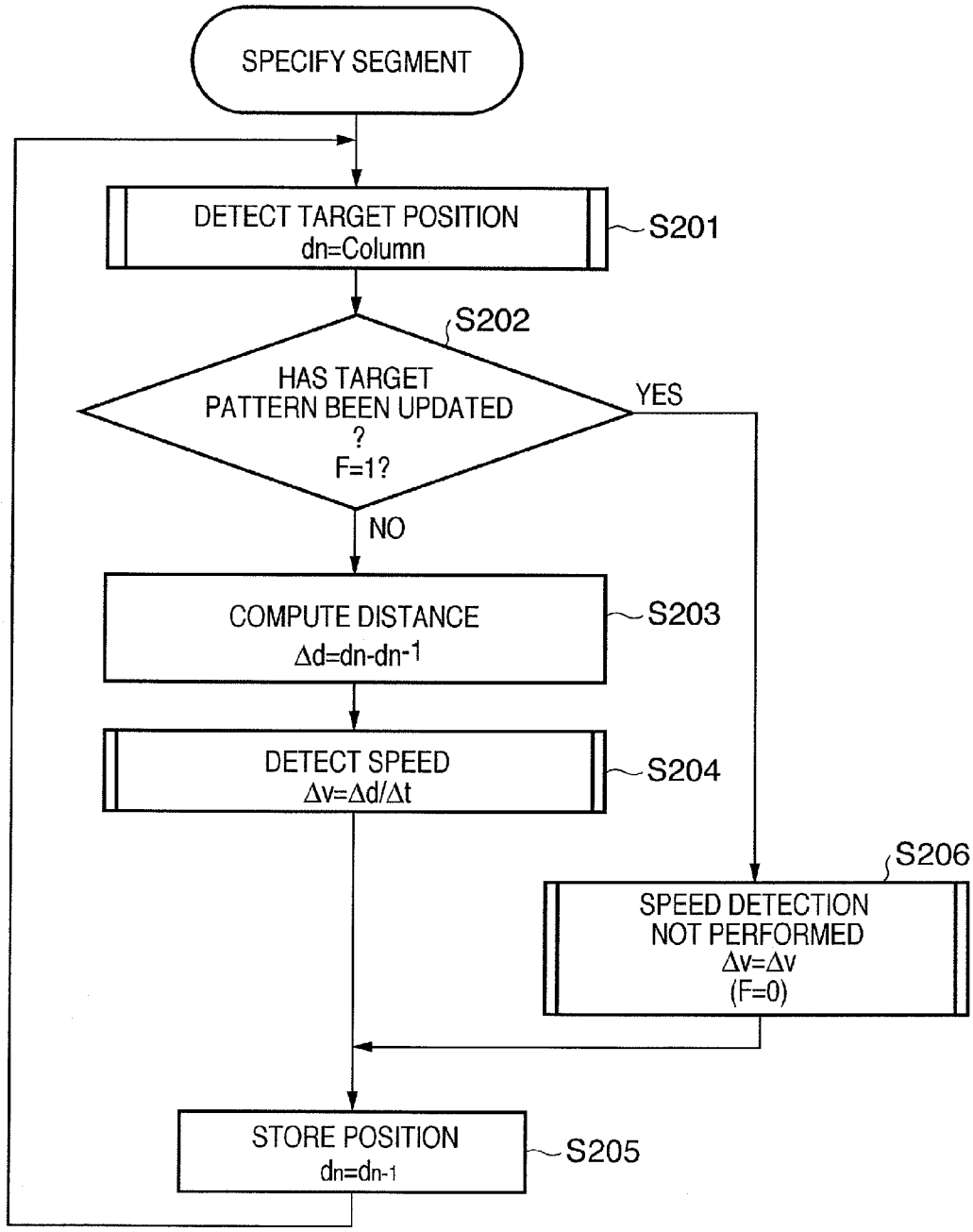
FIG. 16 is a flowchart explaining a DSP segment designation process, according to the embodiment.

FIG. 16 is a flowchart explaining a segment designation process of the DSP 50, according to the embodiment. The process corresponds to the process of the segment designation section 5040. The program that executes the process is stored in the program memory (not shown) of the DSP 50. First, is a description of variables that are used in the process. F denotes the sampling initialization flag. Δt denotes an interval for sampling, dn denotes the barycenter position of the currently detected target pattern, i.e., the column address, and dn-1 denotes the barycenter position of the detected target pattern in the previous iteration. Δd denotes the distance, Δv denotes the moving speed that is detected bin the column orientation, and the column is the address of the barycenter of the target pattern in the column orientation. These variables and the flag are stored in the RAM (not shown) of the DSP 50.

In step S201, the CMOS sensor 34 scans the image data, the target pattern is detected therein, the target pattern is detected therefrom, and the position of the barycenter thereof is set to the target position, i.e., dn=column address. The process then proceeds to step S202, wherein an evaluation is made as to whether or not the target pattern 999 has been updated, in accordance with the flag F that is set in the flowchart in FIG. 15. If F=1, the target pattern 999 is updated, and the process proceeds to step S206, whereupon the position detection value of the previous iteration dn-1 is voided, and no detection of the moving speed is performed. The process proceeds to step S205, with the moving speed Δv being treated as Δv. In step S205, the sampling target position of the previous iteration dn-1 is treated as the latest column address. The process then returns to step S201, wherein the next sampling is performed.

If, on the other hand, the flag F in step S202 is zero, then the target pattern 999 is not updated, and thus, the process proceeds to step S203, wherein the distance Δd is computed from the position dn of the barycenter of the current target pattern, which is derived in step S201, and the position dn-1 of the barycenter of the previous target pattern, i.e., Δd=dn−dn-1. In step S204, the moving speed Δv of the feeding belt 5 is detected from the distance Δd and the sampling interval Δt, which is instructed by the CPU 51, i.e., Δv=Δd/Δt. In step S205, the position dn of the barycenter of the current target pattern is stored as the position dn-1 of the barycenter of the previously sampled target pattern, i.e., dn-1=dn. The process then returns to step S201, wherein the next sampling is performed.

As described above, the position of the target pattern 999 is detected, the distance is derived and the speed of the feeding belt 5 is detected, with the process repeated only if the target position has not been updated.

Figure 17:
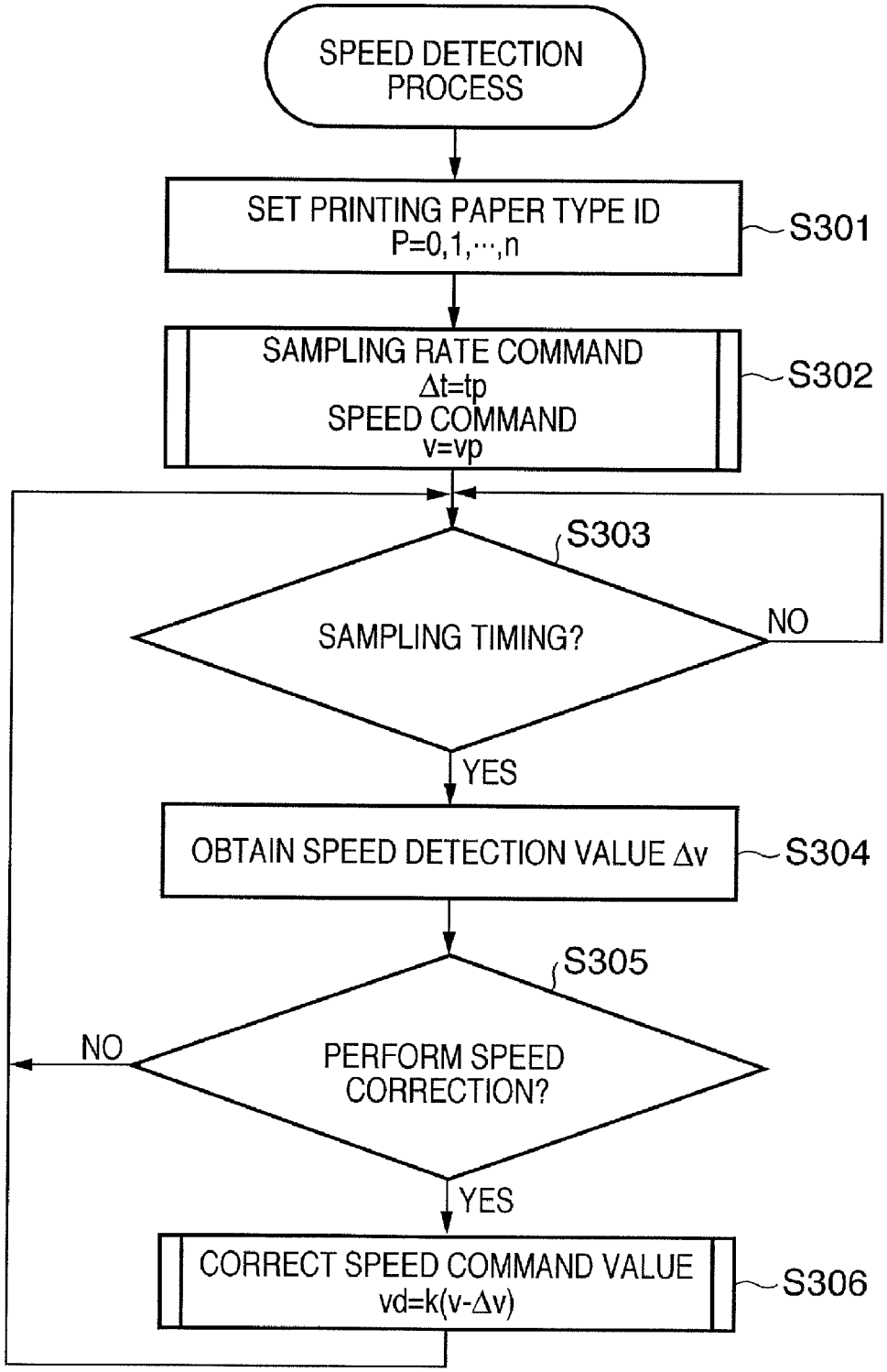
FIG. 17 is a flowchart explaining a process of a CPU of the image forming apparatus detecting the conveyance speed, according to the embodiment.

FIG. 17 is a flowchart explaining a process of the CPU 51 of the image forming apparatus detecting the conveyance speed of the belt, according to the embodiment. A program that executes the process is stored in a program memory (not shown) of the CPU 51. First, is a description of variables that are used in the process. P denotes an ID that denotes the type of the sheet of printing paper, while v denotes the average speed in the column orientation, which is outputted as the speed command 512. Δt denotes the sampling interval, vp denotes the moving speed in the column orientation, i.e., the Y-axis, as per the type of the sheet of printing paper, while tp denotes the sampling rate as per the type of the sheet of printing paper. Δv denotes the moving speed that is detected in the column orientation. k denotes a speed correction coefficient, and vd denotes a speed correction command value in the column orientation. These variables are stored in the RAM (not shown) of the DSP 50.

In step S301, P is set to the printing paper ID that denotes the type of the sheet of printing paper, i.e., zero for regular printing paper, 1 for thicker printing paper, or 2 for extra-thick printing paper. The process proceeds to step S302, wherein the value v of the moving speed of the feeding belt 5 and the value Δt of the sampling rate command are determined, where v=vp, and Δt=tp. In step S303, an evaluation is performed as to whether or not the DSP 50 has commenced the speed detection process and the sampling timing has arrived. If the sampling timing has arrived, the process proceeds to step S304, wherein the DSP 50 obtains the speed detection value Δv. It would be permissible to store the speed detection value Δv thus obtained in the RAM. The process proceeds to step S305, wherein it is determined whether or not an evaluation is made to perform the speed detection. Details are omitted herein, although it would be permissible to perform the speed correction whenever the speed detection is performed, or instead, to derive the acceleration and perform the speed correction when the acceleration is greater than or equal to a predetermined threshold.

If the speed correction is not performed, the process returns to step S303, and waits for the sampling timing. If the speed correction is performed in step S305, the process proceeds to step S306, wherein the corrected speed is computed from the speed correction coefficient k and the obtained speed detection value Δv, i.e., vd=k×(v−Δv). The DSP 50 is notified via the speed command vd of the corrected speed thus computed, whereupon the process returns to step S303, and waits for the sampling timing. The CPU 51 repeats the process until the type of the sheet of printing paper is changed.

Second Embodiment

Figure 18:
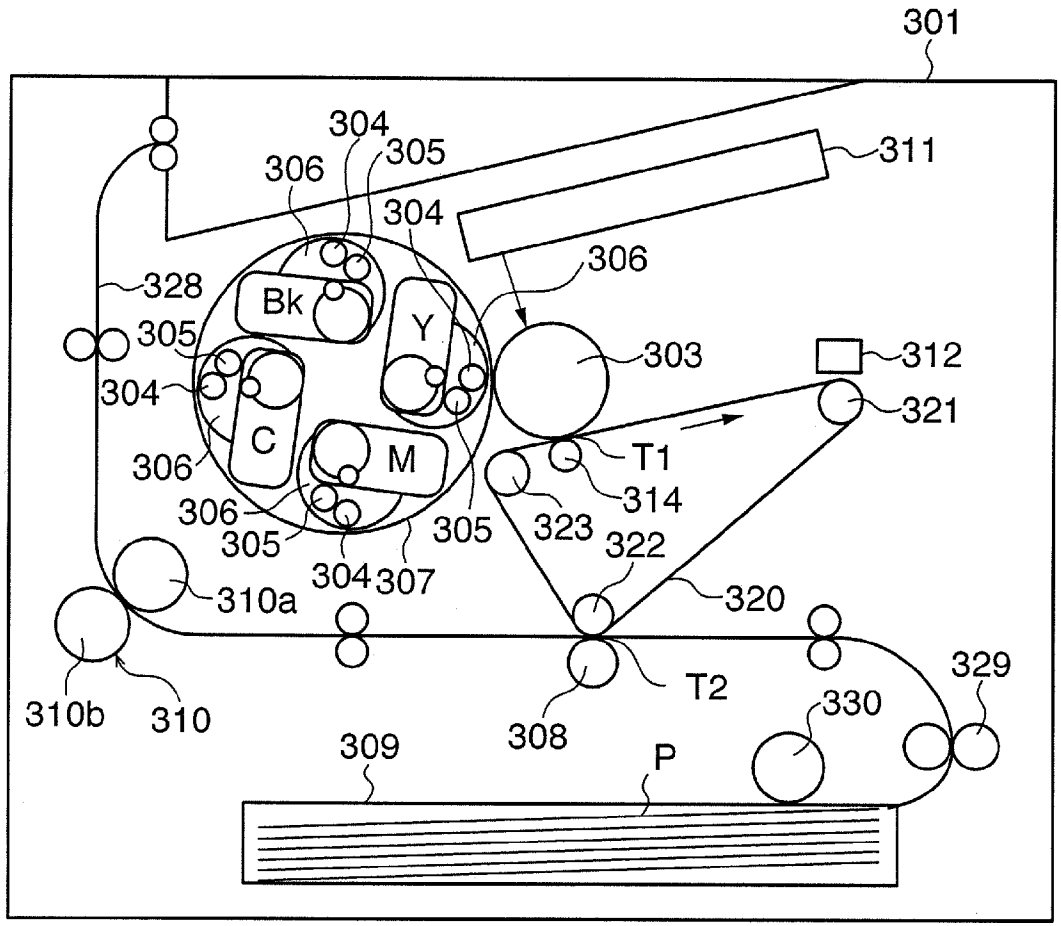
FIG. 18 depicts a cutaway conceptual view illustrating a configuration of an image forming apparatus according to a second embodiment of the present invention.

FIG. 18 depicts a cutaway conceptual view illustrating a configuration of an image forming apparatus according to a second embodiment of the present invention. The figure depicts an instance of an image forming apparatus that employs an intermediate transfer system, i.e., an intermediate transfer belt.

An image forming apparatus 301 forms four electrostatic latent images, i.e., yellow (Y), magenta (M), cyan (C), and black (Bk), in accordance with a laser light generated by a scanner unit 311, on a photosensitive drum 303. The electrostatic latent image corresponding to each respective color is developed as a toner image by a toner corresponding to each respective color of a developer unit 306. The developer unit 306 for each respective color is mounted in a rotary unit 307, and possesses a development sleeve 304, which develops the electrostatic latent image on the photosensitive drum 303, as well as a controller 35, which delivers the toner to the development sleeve 304 in a uniform fashion.

The toner image that is formed on the photosensitive drum 303 is transferred to an intermediate transfer belt 320 via a primary transfer portion T1, over a primary transfer roller 314. The toner image that is thus transferred to the intermediate transfer belt 320 is conveyed to a secondary transfer portion T2.

The sheet of printing paper P that is contained in a printing paper feed unit 309 is conveyed to the secondary transfer portion T2 via a pick-up roller 330 and a printing paper feed roller 329, and the toner image on the intermediate transfer belt 320 is transferred to the sheet of printing paper P via a secondary transfer unit 308. The intermediate transfer belt 320 rolls around a drive roller 321, a tension roller 322, which is positioned opposite the secondary transfer unit 308, and an idler roller 323. A drive motor (not shown) that is linked to the drive roller 312 drives the intermediate transfer belt 320 in the direction of the arrow shown in the drawing.

The secondary transfer portion T2 transfers the toner image of the sheet of printing paper P, which is then conveyed to a fixer unit 310, wherein heat and pressure are applied to the toner image to fix it to the sheet of printing paper P, which is then discharged from the apparatus via a printing paper path 328. The fixer unit 310 comprises a fixing roller 310*a*, which houses a heater, and a pressure roller 310*b*. Reference numeral 312 is a scanning sensor, which scans the image on the intermediate transfer belt 320.

As per the description according to the first embodiment, the image forming apparatus that comprises the intermediate transfer system, i.e., the intermediate transfer belt, places the image sensor unit 312 that comprises the CMOS sensor 34 at a position in opposite to the intermediate transfer belt 320. The sensor 312 identifies the toner image that is formed on the intermediate transfer belt 320, and the DSP 50 derives the relative speed of the intermediate transfer belt 320. Controlling the rotation of the drive motor (not shown), which drives the conveyance of the intermediate transfer belt 320, allows the intermediate transfer belt 320 to be maintained at a constant rotational speed. Doing so in turn allows implementing the image forming apparatus 301 that comprises the intermediate transfer system that has a low degree of color misalignment.

The detection of the moving speed of the intermediate transfer belt 320 using the CMOS sensor 34, as well as the method of correcting the speed of the conveyance drive motor of the intermediate transfer belt 32, may be implemented in a manner similar to the feeding belt 5 according to the first embodiment, and thus, a detailed description thereof is omitted herein. While FIG. 18 depicts a rotary configuration, a tandem configuration would also be similarly applicable thereto.

The foregoing configuration allows detecting the moving speed of the intermediate transfer belt 320 with a high degree of accuracy, without losing the target pattern even if the intermediate transfer belt 320 has a high moving speed. It is thus possible to correct the rotational speed of the conveyance drive motor of the belt, thereby maintaining a given moving speed of the belt 320.

While the determination of the target pattern according to the embodiments is based on an image of the segment S11, the present invention is not restricted thereto. It would be permissible to use an image that is shifted along the X-axis, i.e., in the row orientation, from segment S11, i.e., segment S21, S31, etc., to make the target pattern determination, if segment S11 contains only a non-target image, i.e., an image with little change in density.

While detection of the position of the target pattern is fixed to the X-axis, i.e., the row orientation, according to the embodiments, it goes without saying that segment switching would be performed in a synthesis of the X and Y axes, for example, in a circumstance such as pre-determining the distance of the X-axis component.

While a segment is fixed at 8×8 pixels according to the embodiments, it would be permissible to vary the configuration of the segment to be such as 2×4 pixels or 6×6 pixels. It would also be permissible to change the configuration of the segment each time the surface image is scanned.

While the drive unit and the control unit of the belt motor 56 are presumed to be a DC motor servo control according to the embodiments, it would be permissible to employ a stepping motor to perform such control as well.

According to the embodiments, it would be possible to reduce the number of pixels handled per sampling, and to detect the surface image on either the feeding belt or the intermediate transfer belt with a high sampling rate. Doing so allows detecting the surface speed of the belt with a high degree of accuracy.

The ability to detect the surface image in a wide region on the belt without reducing the sampling rate allows detecting the target pattern without missing the target pattern outside the detection frame, even at a fast detection speed. It is thus possible to detect the moving speed of the belt that is being driven for conveyance at high speed, without having to reduce accuracy in detection.

The ability to provide feedback in real-time of the moving speed of the belt thus detected to the speed control of the drive motor provides the ability to maintain the moving speed of the belt as constant as possible, irrespective of such conditions as the internal temperature of the apparatus, which, in turn, facilitates minimization of misalignment in the image or the color therein.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus for forming an image on a sheet, comprising:

an image carrier being driven by a driving source, configured to carry an image;

an image reading unit configured to read the image upon the image carrier, wherein the image reading unit has a plurality of sensor elements arranged in two dimensions and the plurality of sensor elements are divided into multiple sensor element groups;

a sampling unit configured to sample an output of each sensor element group of the multiple sensor element groups at each of plural sampling times, wherein the sensor element groups respectively have the same number of sensor elements arranged in two dimensions;

a decision unit configured to decide first and second sensor element groups for respectively being sampled at first and second sampling times, wherein the first sampling time is followed by the second sampling time;

a position detection unit configured to detect positions of a predetermined pattern included in an image output from the first sensor element group at the first sampling time and the predetermined pattern included in an image output from the second sensor element group at the second sampling time; and a computation configured to compute a moving speed of the image carrier based on a difference between the first sampling time and the second sampling time and the positions detected by the position detection unit, wherein the decision unit decides the second sensor element group based on an assumption speed of the image carrier and the difference between the first sampling time and the second sampling time.

2. The image processing apparatus according to claim 1, further comprising a drive control unit configured to control the speed of the driving source in accordance with the moving speed computed by the computation unit.

3. The image processing apparatus according to claim 1, further comprising a photosensitive member configured to form a toner image, wherein the image carrier is an intermediate transfer member to which the toner image formed on the photosensitive member is transferred.

4. The image processing apparatus according to claim 1, further comprising a photosensitive member configured to form a toner image, wherein the image carrier is a transfer carrier for a sheet to which the toner image formed on the photosensitive member is transferred is carried and conveyed.

5. The image processing apparatus according to claim 1, wherein the sensor elements other than the second sensor element group are not used at the second sampling.

6. The image processing apparatus according to claim 1, wherein the position detection unit searches the predetermined pattern included in the image output from the first sensor element group in an image output from the second sensor element group at the second sampling.

7. The image processing apparatus according to claim 1, wherein the position detection unit searches the predetermined pattern in the image output from the second sensor element group at the second sampling using a pattern matching method.

8. The image processing apparatus according to claim 1, wherein the predetermined pattern is a part of image output from the first sensor element group at the first sampling.

9. The image processing apparatus according to claim 1, wherein the assumption speed of the image carrier is determined based on the type of the sheet.

* * * * *